United States Patent [19]

Hashimoto et al.

[11] Patent Number: 4,684,069

[45] Date of Patent: Aug. 4, 1987

[54] CLASSIFIER AND CONTROLLER FOR VERTICAL MILL

[75] Inventors: Isao Hashimoto, Akashi; Tosuke Kinoshita; Masahiro Uchida, both of Kobe; Susumu Uchiyama, Nishinomiya, all of Japan

[73] Assignee: Kawasaki Jukogyo Kabushiki Kaisha, Japan

[21] Appl. No.: 764,437

[22] Filed: Aug. 12, 1985

[30] Foreign Application Priority Data

Aug. 18, 1984 [JP] Japan ..... 59-172291

[51] Int. Cl.[4] ..... B02C 4/28

[52] U.S. Cl. ..... 241/79.1; 241/80; 241/119

[58] Field of Search ..... 209/144, 140, 141, 138, 209/139 R; 241/117–121, 80, 97, 48, 52, 53, 33, 30, 79.1

[56] References Cited

U.S. PATENT DOCUMENTS

| | | | |
|---|---|---|---|
| 3,199,797 | 8/1965 | Egt et al. | 241/119 X |
| 3,556,419 | 1/1971 | Frangquist | 241/119 X |
| 3,951,347 | 4/1976 | Tiggesbaumker et al. | 241/119 X |
| 4,084,754 | 4/1978 | Brundiek | 241/119 X |
| 4,550,879 | 11/1985 | Tanaka et al. | 241/97 X |

*Primary Examiner*—Mark Rosenbaum

*Attorney, Agent, or Firm*—Marshall, O'Toole, Gerstein, Murray & Bicknell

[57] ABSTRACT

A vertical mill, a classifier for the mill, and a controller for the classifier. The vertical mill includes a casing having a top plate, and the classifier is adjacent the top plate. Beneath the top plate, upon which impinges an upwardly moving gas and powdery material being supplied from the lower portion of the casing, are provided a plurality of rotary blades or rotary rods which have a vertical axis of rotation. A gap is provided between the rotary blades and the top plate, and an annular impingement member is suspended from the top of the casing to outwardly surround the plurality of rotary blades in such a way as to shield the gap. Further, an opening is provided adjacent the impingement member through which a portion of the gas and powdery material pass. The controller of the classifier includes means for adjusting the opening through which the powdery material passes. A collecting device is provided for collecting powdery material from the classifier, including a detector for detecting the distribution of the particle sizes of the powdery material received by the collecting device and giving an output related to the distribution. A mechanism for adjusting the flow area of the opening in response to the output is also provided.

20 Claims, 36 Drawing Figures

CLASSIFIER AND CONTROLLER FOR VERTICAL MILL

FIELD AND BACKGROUND OF THE INVENTION

The present invention relates to a classifier and its controller, the classifier being operable in a vertical mill, for example, to guide a powdery material by means of a gas flow, and to selectively draw off a portion of the powdery material according to the particle size of the powdery material.

FIG. 26 is a simplified sectional view showing a prior art static type of vertical mill 1. With reference to FIG. 26, in the casing 1*a* of the vertical mill 1 is mounted a table 2 having a vertical rotating axis, and the table 2 is rotated by a drive 3. This table 2 includes a table liner 2*a* for crushing powdery materials. Above the table liner 2*a*, a plurality of angularly spaced crushing rollers 4 are arranged around the circumference of the table. Each crushing roller 4 is rotatably connected to an arm 5 which swings on a pivotal axis 6 so that the angle between the table 2 and the arm 5 can be varied. An upper end of the arm is connected to a pressurizing device 7 which extends out of the casing 1*a*. This pressurizing means 7 presses on the arm 5 in an elastic manner thereby pressing the crushing roller 4 against the table liner 2*a*.

Above the table 2 is installed a feed tube 8 which feeds a raw material, such as a granular material, into the casing and onto the table. Further, above the table 2 is installed a classifier 9 which consists of a generally funnel-like cone 10 and classifying blades 11. In the top plate 12 of the casing 1*a* of the vertical mill 1, an outlet port 13 is provided for drawing the powdery material out of the casing 1*a*. In the casing 1*a* and beneath the table 2 are provided blast or intake ports 14 for supplying a gas flow around the table to raise the powdery material upwardly through the casing 1*a*, as will be explained later.

In a vertical mill 1 of the above-mentioned configuration, a powdery material fed through the feed tube 8 drops on the table 2. As the table 2 is rotated by the driving means 3, the powdery material is moved by the centrifugal action into a gap between the table liner 2*a* and the crushing rollers 4. The powdery material thus crushed between the table 2*a* and the crushing rollers 4 is caused to rise in the casing 1*a* by the gas being fed through the blast ports 14. The powdery material moves up around the outside of the cone 10 and enters, through a guide passage 15 between the cone 10 and the top plate 12, into the classifier through the blades 11. Upon entering, a portion of the powdery material, wherein the particle size is equal to or greater than a predetermined value, is driven downwardly by the classifying blades through the interior of the cone 10, and is guided by the cone 10 and drops again on the table 2*a*. The portion of the powdery material of which the particle size is smaller than the predetermined value is lifted out of the casing 1*a* through the outlet port 13 by the gas flow from the blast port 14. The powdery material which drops through the cone 10 down to the table 2 is mixed with the powdery material being fed by the feed tube 8 and it is again crushed between the table liner 2*a* and the crushing rollers 4.

The vertical mill 1 which crushes material in the aforementioned manner is simple in construction, but it is not capable of producing, at the outlet port 13, a powdery material with an easily or freely-selected particle size distribution. In other words, the powdery material obtainable at the outlet port 13 can be adjusted in fineness ($cm^2/g$) so that it is not larger than a predetermined value by adjusting the angle of the classifying blades 11, but it is not possible to discharge a powdery material having a freely-selected particle size distribution.

FIG. 27 shows a simplified sectional view of another prior art rotary blade type of vertical mill 20, and FIG. 28 is a graph for explaining the classifying function of the vertical mill 20. This prior art mill is generally similar to the prior art mill shown in FIG. 26, and the corresponding parts are indicated by the same reference numbers. The present prior art mill is characterized in that a plurality of circumferentially spaced rotary blades 21 are provided in the upper portion of the casing 1*a*, in place of the cone 10 and the classifying blades 11 which constitute the classifier 9 of the prior art mill shown in FIG. 26.

The rotary blades 21 are secured, at their lower ends as shown in FIG. 27, to a support member 22, and the support member 22, in turn, is fixed to a rotary shaft 24 which is rotatably driven by a drive 23.

In the vertical mill 20 of the above-mentioned configuration, a powdery material fed into the mill by the feed tube 8 rises, after passing through the processes similar to those described in connection with FIG. 26, in the casing 1*a*. In rising, the powdery material moves in such a manner as to pass, together with the gas from the blast port 14, through the spaces between the plurality of rotating blades 21. Since the blades 21 are being driven to rotate as explained above, a portion of the powdery material, the particle size of which is greater a certain predetermined value, is given a large centrifugal force and forced to drop downwardly in the casing 1*a*. On the other hand, the portion of the powdery material the particle size of which is equal to or smaller than the predetermined value, passes through the spaces between the rotary blades 21 and moves out of the casing 1*a* through the outlet port 13. The portion of the powdery material having the excessive particle size, which drops downwardly in the casing 1*a*, is crushed again on the table 2.

The vertical mill 20 of the above-mentioned configuration is capable of adjusting the particle size of the powdery material leaving the outlet port 13 by altering the rotational speed of the rotary blades 21. With reference to FIG. 27, when the rotary blades 21 are rotating at a constant speed, the particle size distribution obtained at the outlet port 13 is indicated by the line 100 of FIG. 28.

When the rotational speed of the rotary blades 21 is reduced, the configuration of the particle sizes of the powdery material leaving the outlet port 13 will be as shown by the line 101 of FIG. 28, according to the Rosin-Rammler paper. If the angle between the line 100 and the axis of the abscissa, and the angle between the line 101 and the axis of the abscissa are denoted by $\theta 1$ and $\theta 2$ respectively, the tangential values N obtained from $\theta 1$ and $\theta 2$ are expressed by the following equations:

$$N1 = \tan \theta 1 \quad (1)$$

$$N2 = \tan \theta 2 \quad (2)$$

As shown in FIG. 28, the values N representing the configuration of particle diameters of the powdery material satisfy the following relation:

$$N1 \approx N2 \quad (3)$$

Although a predetermined fineness ($cm^2/g$) can be freely selected by changing the rotational speed of the rotary blades 21, it is not possible to obtain a freely selected configuration of particle sizes of the powdery material. In FIG. 28, the fineness of the powdery material of the line 100 is higher than that of the line 101 since the overall particle sizes of the line 100 are smaller than those of the line 101. However, it is not possible to adjust $N_1$ and $N_2$ of these lines. In the case of FIG. 26, the angular adjustment of the classifying blades 11 corresponds in results obtained to the rotational speed adjustment of the rotary blades 21 shown in FIG. 27.

In the vertical mill 20 shown in FIG. 27, when clinkers, for example, are to be crushed, it is desirable, in view of the strength achieved when water is added to the cement, and the attendant cost, to set the value of N, and accordingly the configuration of the particle sizes of the powdery material as shown in FIG. 28, so that the powdery material consists of a considerably wide range of particle sizes. In the vertical mill 20, however, since the crushing time of the powdery material is short, there is a problem in that the portion of the powdery material which circulates in the casing 1*a* becomes larger, and in turn the value N gets larger, or the configuration of the particle sizes of the powdery material obtainable at the outlet port 13 is extremely narrow.

FIG. 29 is a simplified sectional view of a prior art static-rotary blade type vertical mill 30. Corresponding parts of the vertical mill 30, which are similar to the above-mentioned prior art mills, are denoted by the same reference numbers. In this prior art vertical mill 30, a classifier 9 consisting of a cone 10 and classifying blades 11 such as those shown in FIG. 26, and the rotary blades 21 such as those shown in FIG. 27, are installed in combination. The raw material, fed through the feed port 8, rises as powdery material in the casing 1*a*, through the processes explained in connection with the above-mentioned prior art mills. The powdery material thus raised is guided into the cone 10 through a guide passage 15 and between the classifying blades 11. Upon entry, a portion of the powdery material of which the particle sizes are equal to or greater than a predetermined particle size, is dropped by the classifying blades 11 along the inner wall of the cone 10 to be collected on the table 2. The portion of the powdery material which has not been so collected is classified, as explained above, by the rotary blades 21 which are driven by the drive 23, and the powdery material thus classified is taken out of the casing 1*a* through the outlet port 13. The remaining portion of the powdery material drops through the cone 10 onto the table 2 and is again crushed.

The vertical mill 30 of such a configuration also has a problem similar to that pointed out for the vertical mill 20 of FIG. 27. Namely, the distribution or configuration of the particle sizes of the powdery material obtainable at the outlet port 13 is narrow, and changing the speed of rotation of the rotary blades 21 changes the central or average value of the particle size distribution of the powdery material, but not the range of particle size distribution of the powdery material; a freely selected range of distribution cannot be obtained.

Thus the problem common to the prior art mills is that it is difficult to adjust the range of configuration of the particle sizes of the powdery material obtainable from the outlet port 13 at any desired level to suit the intended use of the powdery material.

Therefore it is a primary objective of the present invention to provide a classifier and a controller therefor, the classifier being capable of solving the above-mentioned problem and of freely setting the range of the particle size distribution of the powdery material from the classifier at a predetermined desired value.

SUMMARY OF THE INVENTION

A roller mill and a classifier therefor in accordance with this invention includes a casing having a top plate, the classifier being adjacent the top plate. Beneath the top plate, upon which impinges the gas and the powdery material being supplied from the lower portion of the casing, are provided a plurality of rotary blades or rotary rods which have a vertical axis of rotation. A gap is provided between the rotary blades and the top plate, and an annular impingement member is suspended from the top of the casing to outwardly surround the plurality of rotary blades in such a way as to shield the gap. Further, an opening is provided in the impingement member through which a portion of the gas and powdery material pass.

Further, the present invention comprises a controller of the classifier, the controller including means for adjusting the opening through which the powdery material passes. A collecting means is provided for collecting powdery material from the classifier, including a detecting means for detecting the distribution of the particle sizes of the powdery material received by the collecting means and giving an output related to the distribution, and means for adjusting said output to a predetermined value are all activated by the output and the portion of the opening is varied in size by said means for adjusting the portion of the opening.

During the operation of the apparatus, the gas and the powdery material supplied from the lower portion of the casing rise through the casing, and a portion of the powdery material is classified by the rotating blades. In other words, a portion of powdery material having larger particle sizes is given a larger centrifugal force due to impingement on the rotary blades, etc., and these particles descend in the casing. Another portion of powdery material of smaller particle sizes passes through the gaps of the rotary blades and enters an interior space defined by the plurality of rotary blades.

A portion of powdery material not moving towards the rotary blades impinges on the annular impingement member hanging from the top plate and outwardly surrounding the rotary blades, and a part of the remaining portion drops in the casing 1*a* and becomes classified by said rotary blades.

Thus, an opening is provided in the impingement member, and a portion of the powdery material impinging on the impingement member is guided through the opening to the outlet port without being classified by the rotary blades. Accordingly, the powdery material passing through the opening contains some powdery material of larger particle sizes which have not been classified by the plurality of rotary blades. Thus, the powdery material having passed through the classifier and some having passed through said opening are mixed together and are taken out of the casing. The powdery material thus taken out of the casing is collected by a collecting means. A value corresponding to the particle size distribution of the collected powdery material is then sensed by a detecting means, and means is activated for adjusting the powdery material so that the detected value matches a predetermined value. The adjusting means adjusts the size of passage and/or adjusts the rotary blade speed for achieving this particle size adjustment.

BRIEF DESCRIPTION OF THE DRAWINGS

The invention will be better understood from the following description taken in conjunction with the accompanying drawings wherein.

DETAILED DESCRIPTION OF THE DRAWINGS

Figure 1:
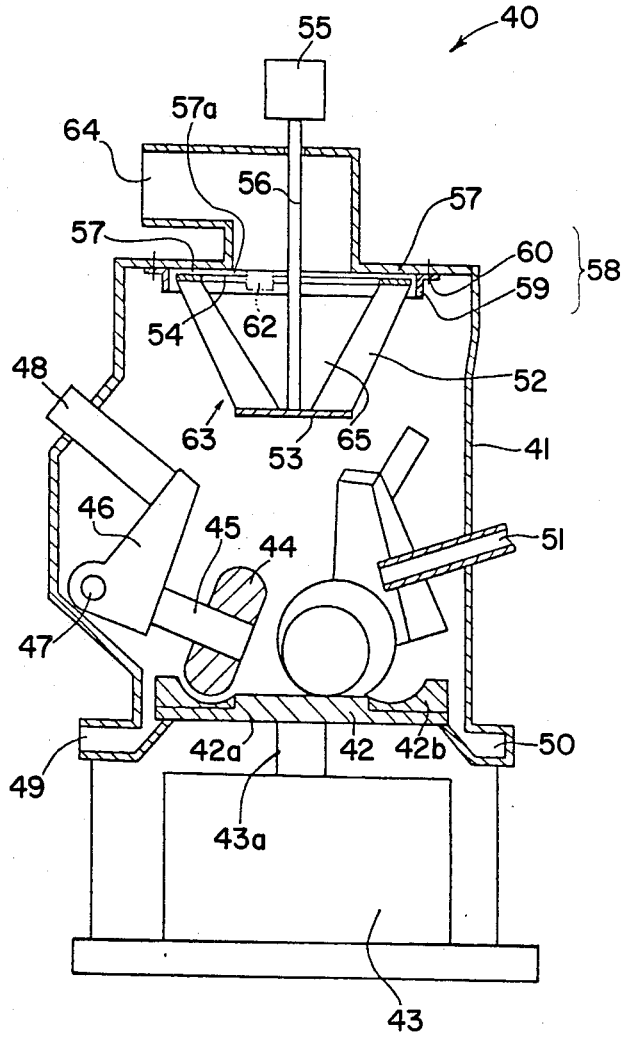
FIG. 1 is a sectional view of a vertical mill according to a first embodiment of the present invention.
Figure 2:
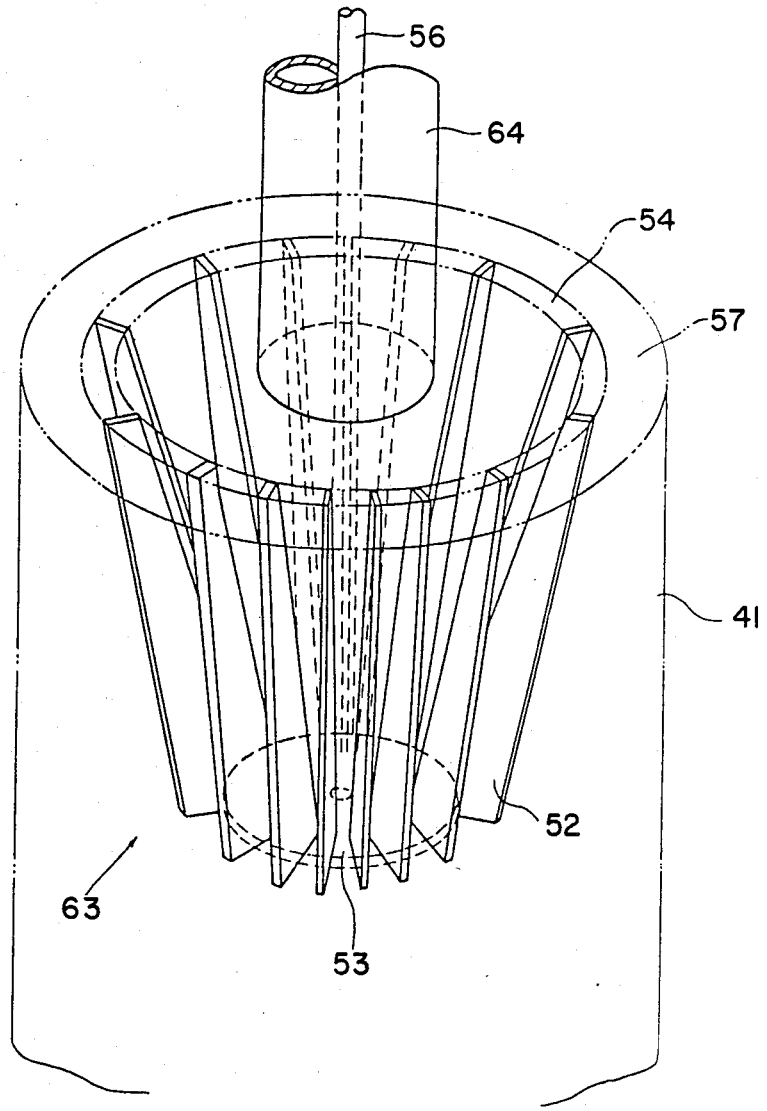
FIG. 2 is a simplified perspective view of the upper portion of the vertical mill.
Figure 3:
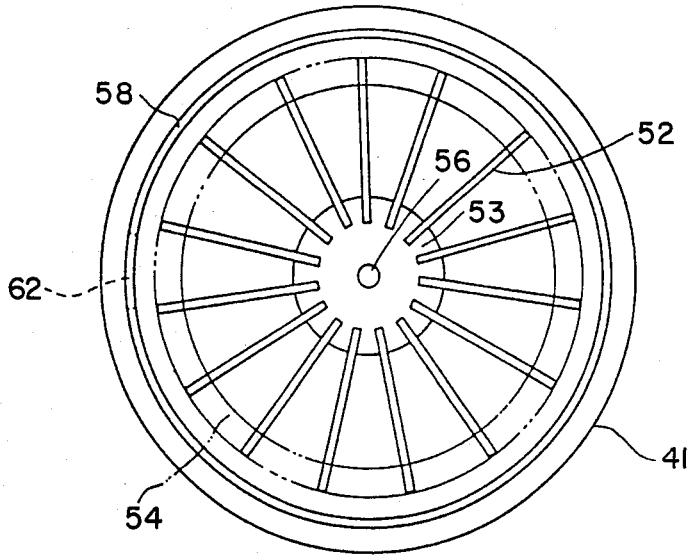
FIG. 3 is a simplified plan view of the upper portion of the vertical mill.
Figure 4:
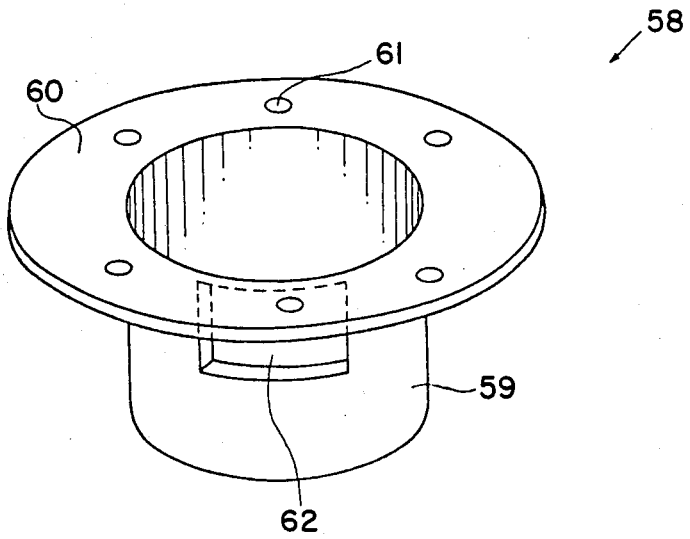
FIG. 4 is a perspective view of an impingement member.

With reference to FIGS. 1 through 4, the vertical mill 40 includes a casing 41, a rotary table 42 having a central vertical axis of rotation being located within the casing, and the table being arranged to be rotatively driven by a drive 43 having a power shaft 43*a*.

The table 42 consists of a table body 42*a* and an annular table liner 42*b* fixed to the outer periphery of the table body 42*a*, the liner having an annular groove. Above the table liner 42*b*, a plurality of angularly spaced freely rotatable rollers 44 are located. A support shaft 45 of each crushing roller 44 is connected to an arm 46 which is movable on a pivot pin 47 so that the angle between the support shaft 45 and the table can be varied. The end of the arm 46, opposite to the pivot pin 47, is connected to a pressurizing means 48 which extends outward from a hole in the casing 41. This pressurizing means 48 elastically presses against the arm 46, and consequently the crushing roller 44 is pressed toward the table liner 42*b*.

Beneath the table 42 and within the casing 41, a gas intake or blast port 49 is provided to feed a gas for blowing upwardly in the casing and carrying a powdery material as will be explained later. The gas fed from the blast port 49 passes through an annular gas conducting passage 50, such as a duct installed beneath the table 42 and surrounding the table 42, and the gas blows up from below the table 42 and all around the circumference of the table. In the casing 41 and above the table 42, a material feed tube 51 which feeds the raw material onto the table 42 extends outward through a hole in the casing 41.

Further, above the table 42 and adjacent a top plate 57 of the casing, a plurality of angularly spaced rotary blades 52 having a vertical axis of rotation are provided. The lower ends of the rotary blades 52 are fixed to a disc 53 around the disc circumference. The rotary blades 52 are flat (see FIG. 2) and extend radially outward and upwardly towards the top plate 57 of the casing 41, and their upper ends are fixed to an annular ring member 54. Attached to the center of the disc 53 is a drive shaft 56 which is rotatively driven by a driving means 55 (FIG. 1). A gap 57*a* of a predetermined size is intentionally provided between the ring member 54 and the top plate 57.

An annular impingement member 58 is provided, hanging from the top plate 57 of the casing 41, and outwardly surrounding the upper portion of the rotary blades 52 and the member 54, thereby shielding the above-mentioned gap 57*a*. With reference to FIG. 5, the function of the impingement member 58 will now be explained. The impingement member 58 has an approximately cylindrical part 59 which externally surrounds the rotary blades 52, and the cylinder part 59 is a little longer than the above-mentioned gap 57*a;* a flange 60 of the member 58 is fixed to the top plate 57. In the flange 60, a plurality of through holes 61 are formed, and by means of these through holes the impingement member 58 is secured to the top plate 57 by means of bolts (not illustrated). Further, in the cylinder 59, an opening 62 is formed to provide a gap or opening through which powdery material of relatively large particle sizes is removed, as will be explained later.

This impingement member 58 and the above-mentioned rotary blades 52 essentially constitute a classifier 63, and the powdery material having passed through the classifier 63 is discharged from an outlet port 64 in the top plate 57.

The operation of the vertical mill 40 having the above-mentioned configuration will now be explained. With reference to FIG. 1, the raw material to be pulverized is fed by the feed tube 51 and drops onto the rotating table 42. As the table 42 is rotated by the driving means 43, the material on the table 42, under the influence of the centrifugal force, moves into the groove and towards the space between the table liner 42*b* and the crushing rollers 44 where the material is crushed. The crushed powdery material rises in the casing 41 due to the gas flow through the passage 50 and the blast port 49. The relation between the particle sizes of the powdery material immediately after crushing and the proportions by weight of the particles of the respective sizes to the entire material is shown by the curve 202 of FIG. 5A. The point P1 on the abscissa of FIG. 5A shows the central or average value of the particle size of the powdery material after crushing.

A portion of the powdery material rising in the casing 41 moves, following the stream of the gas, through the gaps in between the rotary blades 52, and in the process, a part of the powdery material is given a radially outward momentum. Of this part of the powdery material, a portion of the powdery material having particle sizes greater than a certain particle size, which is predetermined by the velocity of the gas flow, the rate of rotation of the rotary blades, etc. escapes from the gas stream and drops in the casing 41. This dropped powdery material falls onto the table 42 and is crushed once again together with new material added by the tube 51.

Figure 5A:
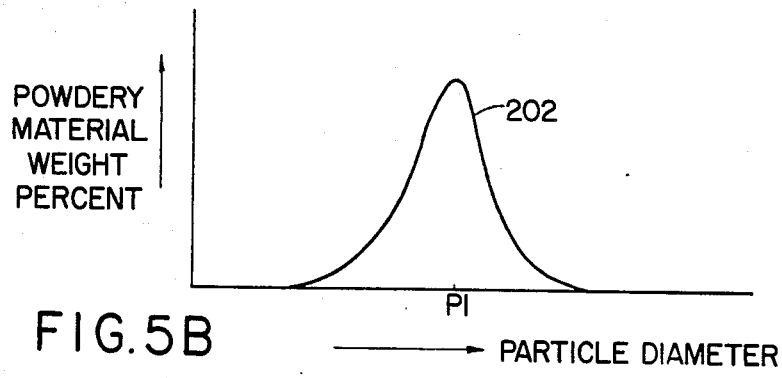
FIGS. 5A to 5E are a set of graphs for explaining the operating conditions of the vertical mill.
Figure 5B:
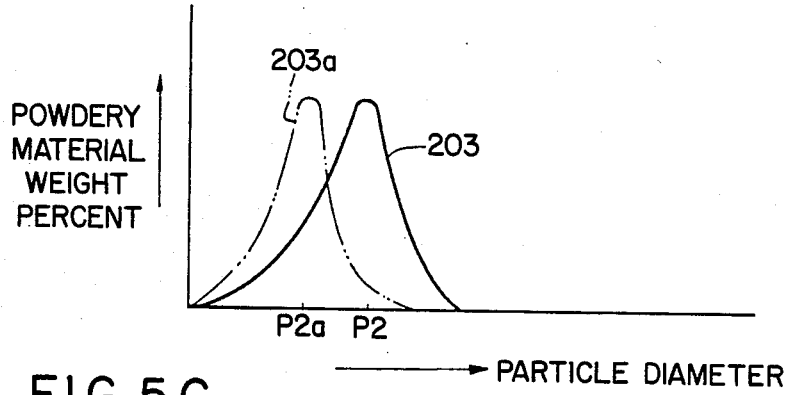

The relation between the particle sizes of the powdery material having passed through the above-mentioned rotary blades 52 and the proportions by weight of the particles of the respective sizes in the total material, is indicated by the line 203 of FIG. 5B. The line 203*a* shows a similar distribution in which the rate of rotation of the rotary blades 52 is greater than that represented by the case of the line 203. The points P2 and P3 on the abscissa are the respective central or average values of the particle size.

When the line 203 of FIG. 5B is compared with the line 202 of FIG. 5A, it is shown that the powdery material that has passed through the rotary blades 52 consists of a portion of relatively smaller particle sizes having been selected from the total of the powdery material crushed by the crushing rollers 44.

A part of the powdery material rising in the casing 41 impinges on the impingement member 58. Of this portion of the powdery material, a portion of the powdery material which passes through the opening 62 formed in the impingement member 58 is not classified by the rotary blades 52, and it moves through the gap 57*a* between the member 54 and the top plate 57, and it moves into a central space 65 defined by the rotary blades 52, the disc 53 and the ring member 54, or towards the outlet port 64. The relation between the particle sizes of the powdery material having passed through the opening 62 and the proportions by weight of the particles of the respective particle sizes is shown by the line 204 of FIG. 5C. It is shown that this portion of the powdery material contains particles of which the particle sizes are greater than those of the powdery material which has passed through the gaps in between the rotary blades 52 as shown by FIG. 5B .

As discussed above, the powdery material which has moved through the opening 62 is mixed with the powdery material which has been classified by and moved through the rotary blades 52 and has entered into the space 65, and the mixture is taken out of the casing 41 through the outlet port 64. The relation between the particle sizes of the powdery material thus produced and the proportions by weight of the respective particle sizes to the total weight of the powdery material is shown by the curve 205 of FIG. 5D. The point P4 on the abscissa is the average or central value of the particle size for the curve 205. The curve 206 shows the particle size distribution when the classifying operation of the opening 62 is not made, and the classification is effected by the rotary blades 52 alone, and the rate of rotation of the rotary blades 52 is adjusted so that the average or central value of the particle size of the powdery material becomes P4.

Figure 5C:
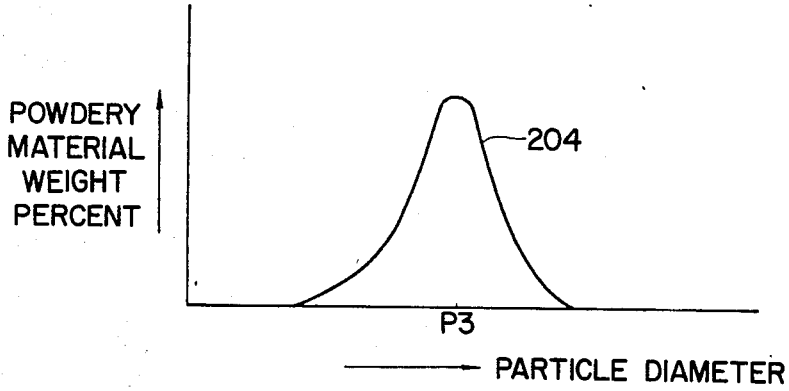
Figure 5D:
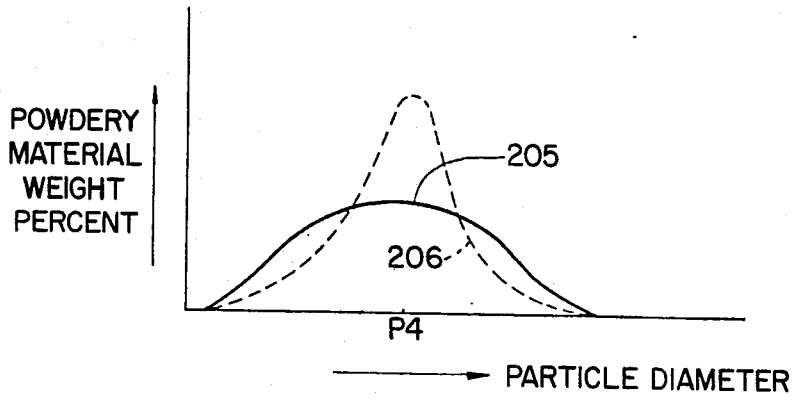

The curves of FIG. 5D shows that the size configuration of the powdery material obtainable at the outlet port 64 contains, as explained above, a wide range of particle sizes.

Figure 5E:
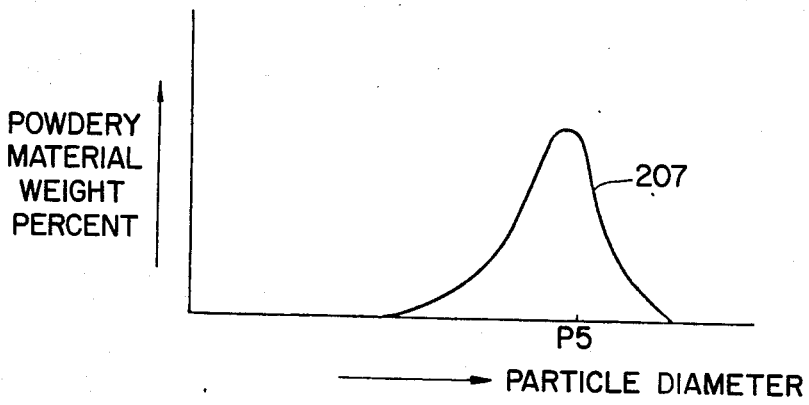

The curve 207 of FIG. 5E shows the size configuration of the powdery material which is classified by the rotary blades 52 and drops in the casing 41 without moving into the space 65. Such powdery material contains relatively larger particle sizes of the powdery material.

Figure 6A:
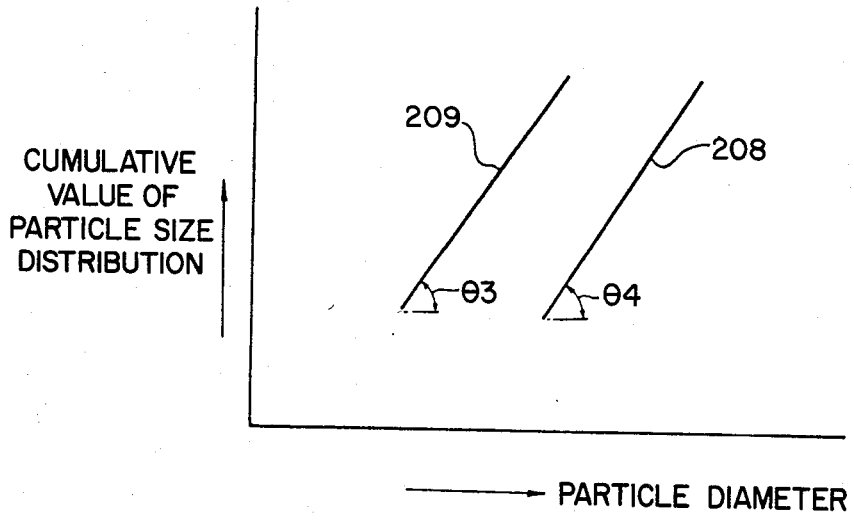
FIG. 6A and 6B are a set of graphs for explaining the functioning of a classifier.
Figure 6B:
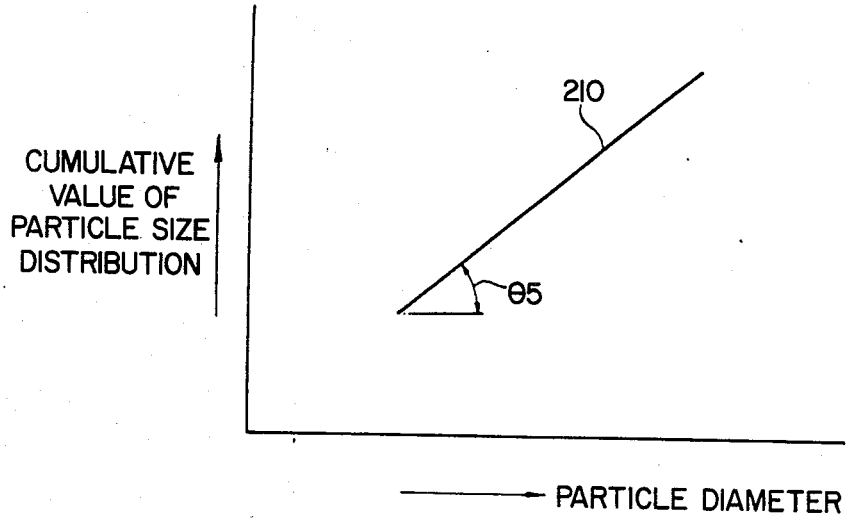

FIG. 6A is an expression of the curve 203 of FIG. 5B, and FIG. 6B is an expression of the curve 205 of FIG. 5D, both being in the form described in the Rosin-Rammler paper. The line 208 and the line 209 of FIG. 6A correspond to the curve 203 of FIG. 5B and the line 204 of FIG. 5C, respectively. The angles made by the lines 209 and 208 with the abscissa are $\theta 3$ and $\theta 4$, respectively, and their tangential values are N3 and N4.

$$\tan \theta 4 = N4 \quad (4)$$

$$\tan \theta 3 = N3 \quad (5)$$

$$\tan \theta 5 = N5 \quad (6)$$

The following relations are established between the tangential value N5 of the angle $\theta 5$ which is made by the line 210 of FIG. 6B with the abscissa and the tangential value N3 of the above-mentioned angle $\theta 3$:

$$N5 < N3 \quad (7)$$

$$N5 < N4 \quad (8)$$

In other words, in the present embodiment of the invention, it is possible to obtain a powdery material having a wide range of particle size distribution with a freely selected central value of particle size by freely selecting the central particle diameters P2 and P3.

Figure 7:
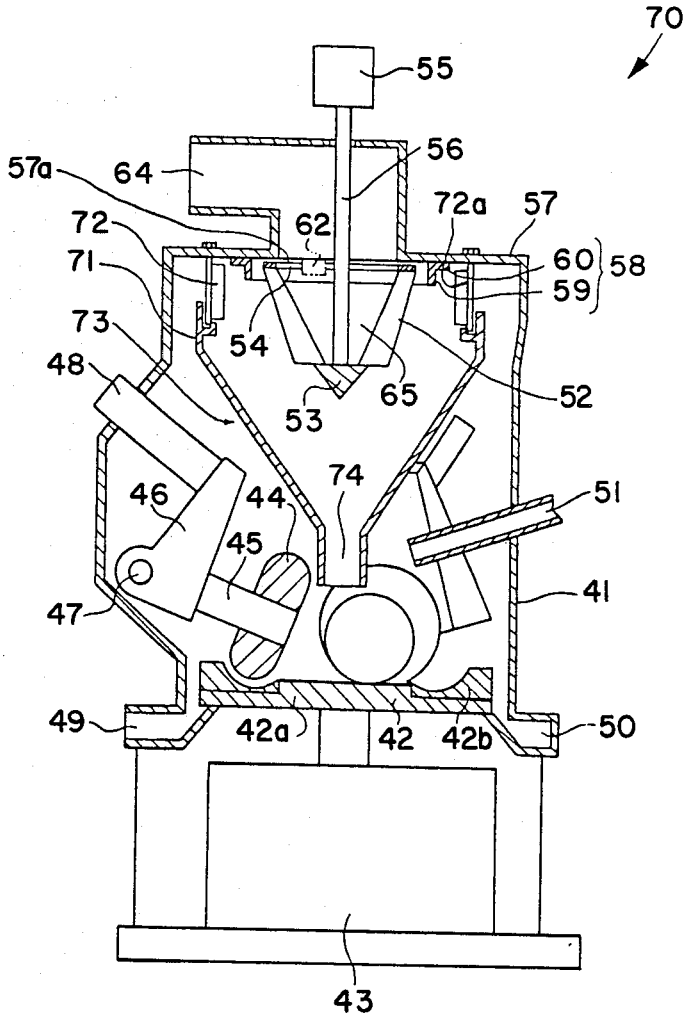
FIG. 7 is a sectional view of a vertical mill according to a second embodiment of the present invention.

FIG. 7 is a sectional view of a vertical mill 70 according to the second embodiment of the present invention, which is generally similar to the preceding embodiment. The corresponding parts are given the same reference numbers. It should be noted that, in the present embodiment, within the casing 41 are provided an approximately funnel-shaped cone 71 and classifying blades 72, and the cone 71, the classifying blades 72, rotary blades 52 and an impingement member 58 essentially constitute a classifier 73.

The cone 71 is an inverted cone in shape, and is provided coaxially above the table 42. At the apex of the cone, which is the closest part to the table 42, a drop port 74 is formed for dropping powdery material as will be explained later. In the upper interior of the cone 7 of FIG. 7, a plurality of classifying blades 72 which are circumferentially arranged on a vertical axis are provided. Inside the cone 71 and the classifying blades 72 are also provided rotary blades 52 and an impingement member 58 having a configuration similar to that of the first embodiment.

The operation of the vertical mill of FIG. 7 is generally similar to that of FIG. 1 and is as follows: Raw material is fed by a feed tube 51 onto the table and crushed between a table liner **42*b* and crushing rollers 44. The distribution by weight of the powdery material, which has been crushed but not classified as yet, according to the particle size is as shown by the curve 202 of FIG. 5A. The crushed powdery material, rising with the gas flow from the blast port 49, rises in the casing and is guided to the classifying blades 72 near the top of the cone 71**.

The classifying blades 72 are angled to impart a swirl to the gas being guided into the cone 71. As a swirling flow is generated and directed towards the center of the cone by the classifying blades 72, the powdery material being carried by the gas is given a centrifugal force. Accordingly, particles of larger diameters reach the wall of the cone 71 and collect towards the drop port 74. The particles drop through the drop port 74 and onto the table 42. On the table 42, the powdery material is mixed with raw material from the feed tube 51 and is crushed again. The classifying blades 72 thus make the first classification and remove the coarse particles having very large diameters. The strength of the gas swirl is adjustable by turning the support rods **72*a* which fasten the blades 72 to the top plate 57 and thereby adjusting the mounting angle of the classifying blades 72**. The greater the angle and the swirling force, the finer will be the classified powdery material.

In the cone 71, the powdery material moving to the rotary blades 52 is again classified as described in connection with the first embodiment, and a portion of the material descends in the cone 71 and drops upon the table 42, and the remaining portion enters the space 65. The configuration by weight of the powdery material inside the space 65 according to the particle diameter is as indicated by the lines 203 and **203*a*** of FIG. 5B.

Now, in the cone 71, a portion of the powdery material enters the space 65 through the opening 62 formed in the impingement member 58. Since this portion of the powdery material having entered the space 65 has not been classified by the rotary blades 52, it contains many particles of larger diameters. The weight distribution according to the particle size is indicated by the curve 204 of FIG. 5C.

In the outlet port 64, the powdery material having passed through the rotary blades 52 and the powdery material having passed through the opening 62 are mixed together, and the mixture has a weight distribution which is indicated by the curve 205 of FIG. 5D. The rotary blades 52 and the impingement member 58 thus execute a secondary classification. As a result of these classifications, the weight distribution of the powdery material dropping in the cone 71 is as shown by the curve 207 of FIG. 5E. Further, when the rate of rotation of the rotary blades 52 is altered, effects similar to those described in connection with the first embodiment, with specific reference to FIG. 6, are observed.

The powdery material in the space 65 after the above-mentioned classifications is removed from the casing 41 through the outlet port 64.

In the present embodiment of FIG. 7, classification with a central or average value of freely selected particle size and a wide range of particle size distribution is achieved, since the classifier 73 is essentially constituted by the cone 71, the classifying blades 72, the rotary blades 52 and the impingement member 58.

FIGS. 8 to 11 show an impingement member 58 of the third embodiment of the present invention. The present embodiment is generally similar to the above-mentioned embodiments and the corresponding parts are given the same reference numbers. The overall configuration of the impingement member 58 is similar to that of an inverted hat without a bottom (see FIG. 4). The impingement member 58 consists, for example, of three arcuate sections **58*a*, 58*b* and 58*c* of the same shape (see FIG. 9), and the three sections are fixed to the top plate through a plurality of through holes 61** with bolts (not illustrated).

Figure 8:
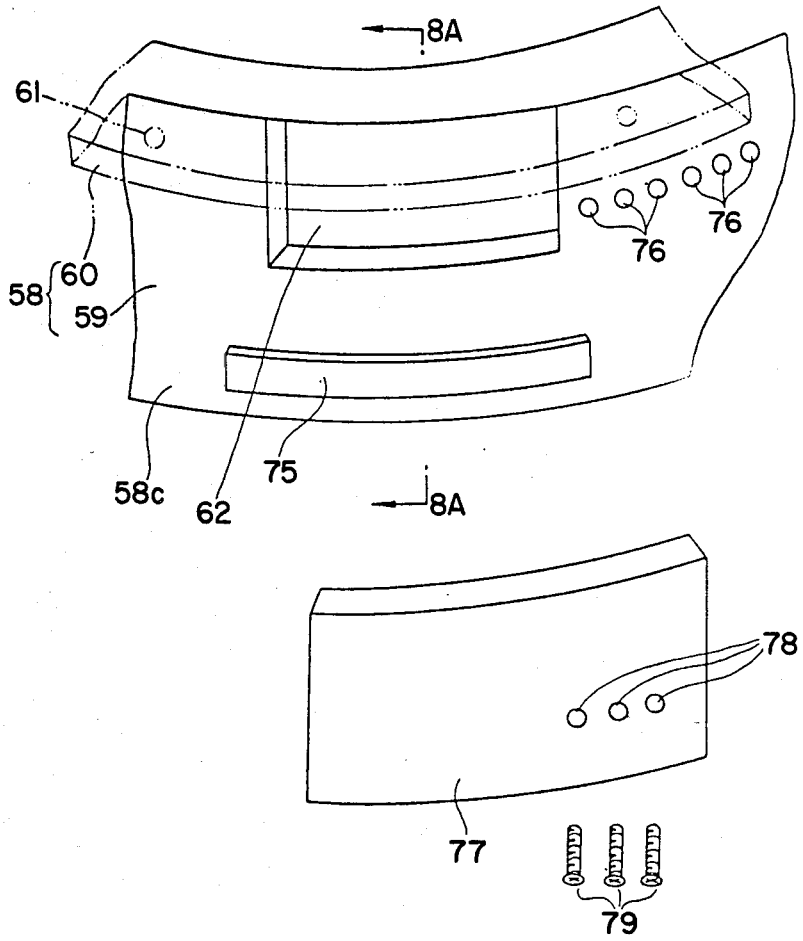
FIG. 8 is an exploded perspective view of a part of an impingement member of a third embodiment of the present invention.
Figure 8A:
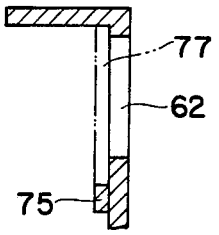
FIG. 8A is a sectional view taken along the section line 8A—8A of FIG. 8.
Figure 9:
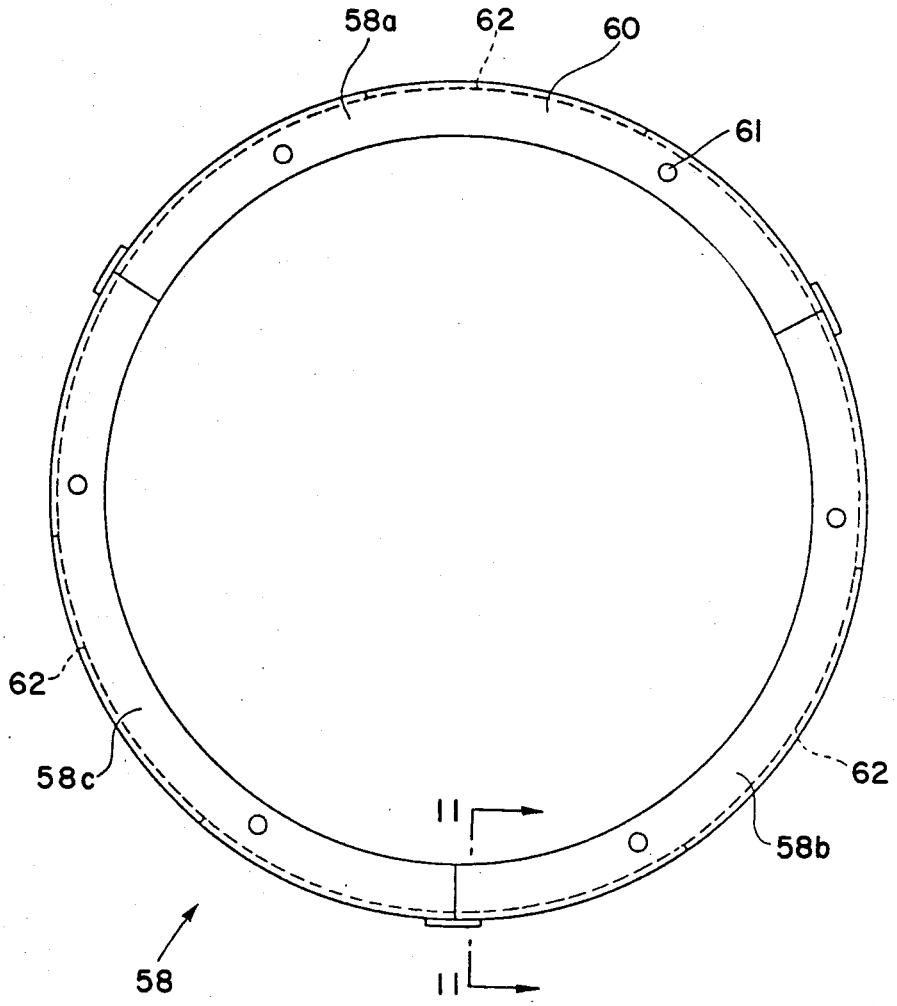
FIG. 9 is a plan view of the impingement member of FIG. 8.
Figure 10:
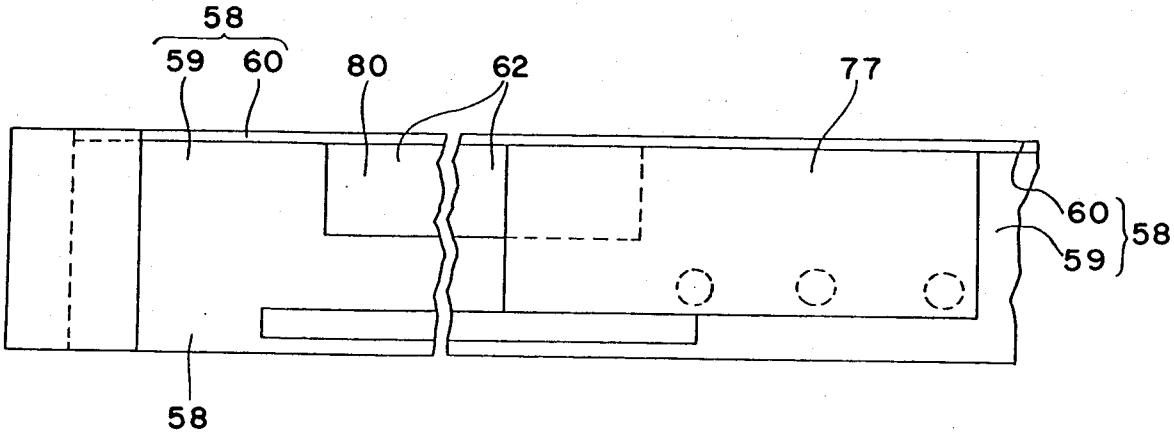
FIG. 10 is a front view of a part of the impingement member of FIG. 9.
Figure 11:
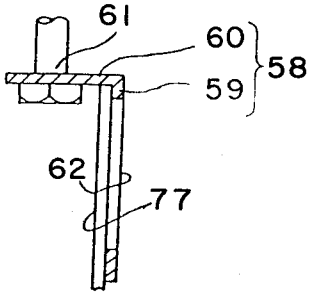
FIG. 11 is a sectional view taken along the section line 11—11 of FIG. 9.

The member section **58*b*, for example, has an opening 62. Further, the member section 58*b*, for example, is provided with a plurality of through holes 76 (FIG. 8). A cover 77 is provided to partially cover the opening 62, and the cover 77 is provided with through holes 78. By means of the through holes 78 and 76, the cover 77 can be fixed to the impingement member 58*b* with, for example, screws 79. The bottom of the cover 77 is arranged to ride on the top of a guide plate 75, and the cover can slide over the top. The cover 77 and the impingement member 58 are arranged so that a portion of the opening 62 through which the powdery material, etc. passes, or the area of the opening 62, can be varied by shifting the position of the cover 77 over the opening 62 and matching the through holes 78 to any desired through holes 76 and fixing them together with the screws 79**.

It, therefore, is possible to alter the quantity of the powdery material which enters the impingement member 58 by altering the area of the passage 80 (FIG. 10) which is the uncovered part of the opening 62. The product A collected at the outlet port 64 (having the particle diameter distribution of the curve 205 of FIG. 5D) is a mixture of the product B which passes through the rotary blades 52 and contains much fine powder (having the particle diameter distribution of the curve 203 of FIG. 5D), and the product C, which contains coarse powder from the opening 62 (having the distribution of the curve 204 of FIG. 5C); and the proportion of the product C in the product A is altered by adjusting the area of the opening 62. Thus, it is possible to adjust the quantity of coarse powder of the curve 205 of FIG. 5D). As it is also possible to adjust the width of the particle size distribution of the line 205 by adjusting the speed of the rotary blades 52, the size of the average diameter value P5 of the product A (having the particle diameter distribution of the curve 207 of FIG. 5E) can be freely selected.

Figure 12:
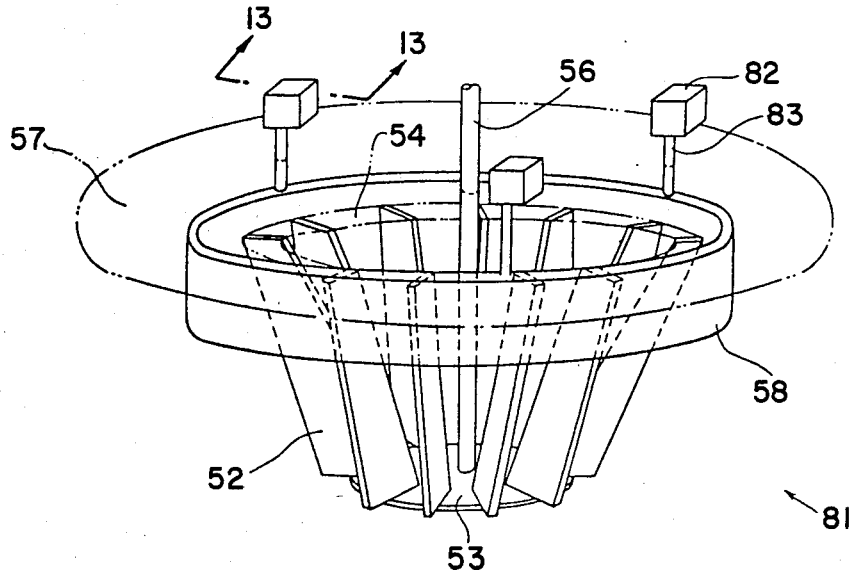
FIG. 12 is a simplified perspective view of a vertical mill according to a fourth embodiment of the present invention.
Figure 13:
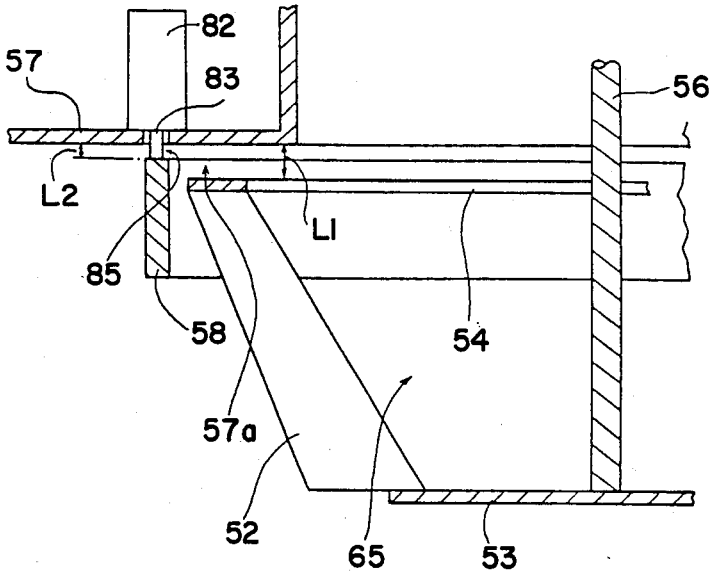
FIG. 13 is a sectional view taken along the section line 13—13 of FIG. 12.

FIG. 12 is a simplified perspective view of the vertical mill 81 of the fourth embodiment of the present invention, and FIG. 13 is a sectional view along the line 13—13 of FIG. 12. This present embodiment is similar to, for example, the above-mentioned first embodiment, and the corresponding parts are given the same reference numbers. Since the basic configuration of the vertical mill 81 of the present embodiment is similar to that of the vertical mill 40 illustrated in FIG. 1, only special points of difference are described.

One point to note with respect to the present embodiment is that a cylindrical plate, instead of the impingement member 58 fixed to the top plate 57 as shown in FIG. 1, is used as the impingement member 58, and it is fixed to a plurality of rods 83 which are driven individually by a plurality of hydraulic cylinders 82 to extend or retract. The impingement member 58 thus is arranged to be shifted parallel to its axis, or toward and away from the top plate, by the hydraulic cylinders 82. In this arrangement, each rotary blade 52 is arranged to have a clearance 57*a* of L1 in height between the upper end of the blade 52 and the top plate 57. The height L1 of the clearance 57*a* is at least sufficient to allow coarse particles, which are indicated by the curve 204 of FIG. 5C of the first embodiment, to flow without clogging.

The end of the impingement member 58 which is on the side adjacent the rod 83 has a clearance 85 (FIG. 13) of L2 in height from the top plate 57 all around the circumference, and this height L2 can be freely altered by means of the hydraulic cylinders 82. Accordingly, the quantity of the powdery material which flows into the space 65 through the clearances 85 and 57*a* can be adjusted by adjusting the height L2 of the clearance 85. In other words, of the powdery material having the distribution of FIG. 5A of the first embodiment, the portion having passed through the rotary blades 52 has a distribution indicated by the curve 203 of FIG. 5B and the portion having passed through the clearances 85 and 57*a* is shown in FIG. 5C. These powdery materials with different average values of particle diameter are mixed together in the space 65 or at the outlet port 64 to obtain the distribution curve indicated by FIG. 5D.

Further, the present embodiment has a classifying capacity which allows free setting of the distribution width of the particle diameter with an average value of particle diameter which is freely selected, by altering the length L2 of the clearance 85 and the rate of rotation of the rotary blades 52.

In the above-mentioned embodiment, the impingement member 58 is movable by hydraulic cylinders 82. It may instead be shifted by other means such as screws in place of the hydraulic cylinders 82.

Figure 14:
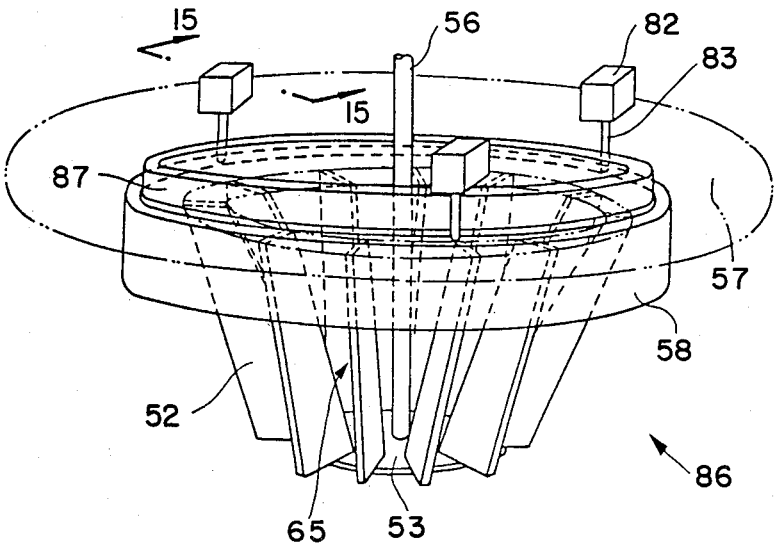
FIG. 14 is a simplified perspective view of a vertical mill according to a fifth embodiment of the present invention.
Figure 15:
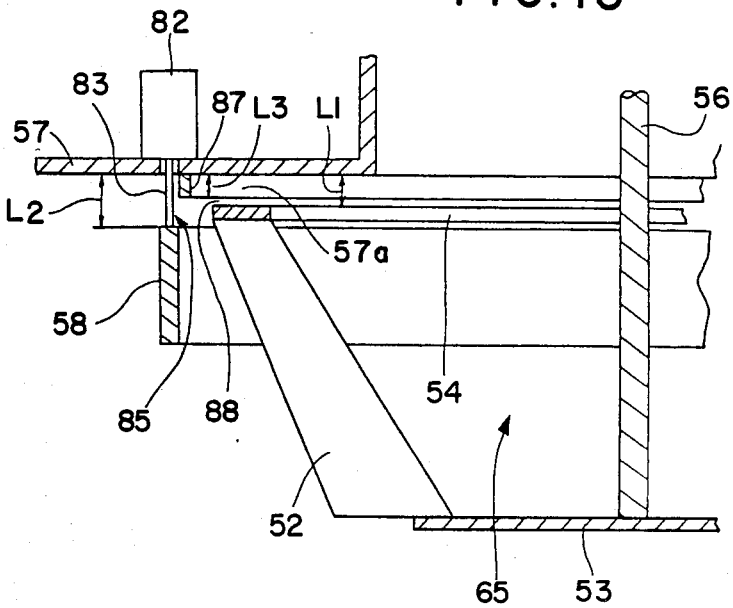
FIG. 15 is a sectional view along the section line 15—15 of FIG. 14.

FIG. 14 shows a simplified perspective view of a vertical mill including the fifth embodiment of the present invention, and FIG. 15 is a sectional view along the line 15—15 of FIG. 14. The present embodiment is similar, for example, to the above-mentioned fourth embodiment, and the corresponding parts are given the same numbers. Since the basic configuration of the vertical mill 86 of the present embodiment is similar to that of FIG. 13, only special points of interest are described.

One point to note in the present embodiment is that an annular shield member 87 is fixed on one end to the top plate 57 and hangs from the top plate 57, and extends between the rotary blades 52 and the impingement member 58. The vertical height L3 of the shield member 87 is arranged to be shorter than the height L1 of the clearance between the rotary blades 52 and the top plate 57. The distance L2 between the impingement member 58 and the top plate 57 can be freely set by, for instance, vertically displacing the impingement member 58 as shown in FIG. 15 by the extension or contraction of the rods 83 of the hydraulic cylinders 82.

With this arrangement, a portion of the powdery material near the top plate enters the central space 65 through the clearance 85 between the impingement member 58 and the top plate 57, and through the clearance 88 between the shield member 87 and the rotary blades 52. Thus, a powdery material having a broad range of distribution indicated by the curve 205 of FIG. 5D can be obtained. Further, the present embodiment has a classifying capacity which allows free setting of distribution width of the particle diameter with an average value of particle diameter freely selected, by altering the height L2 of the clearance 85.

Figure 16:
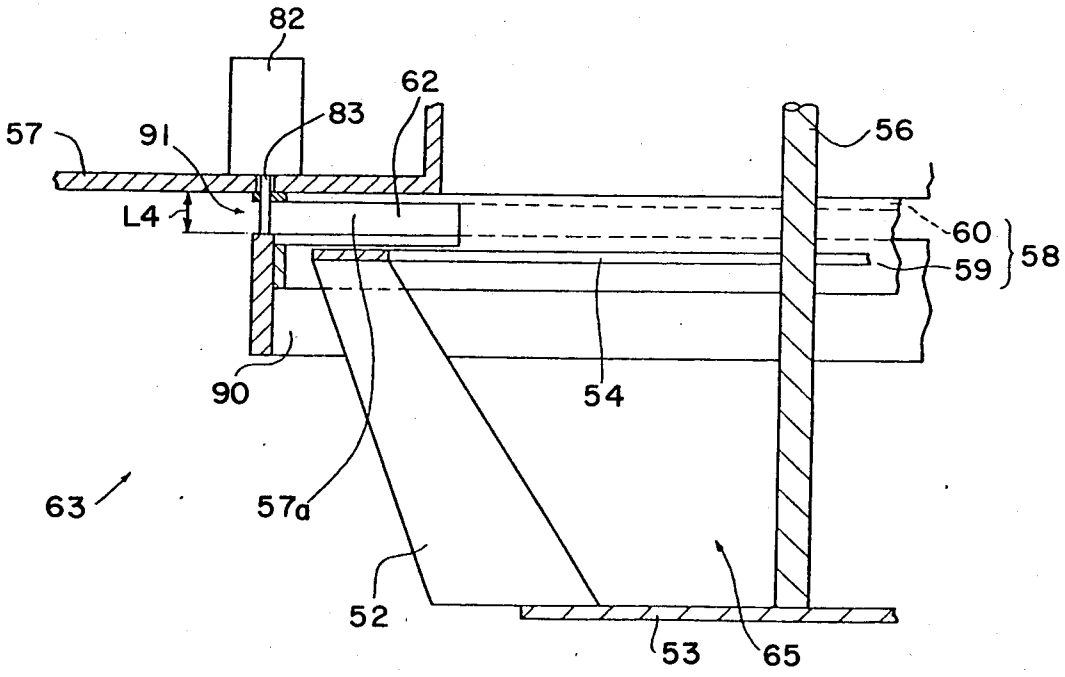
FIG. 16 is a simplified sectional view of a portion of a classifier for a vertical mill according to a sixth embodiment of the present invention.

FIG. 16 is a simplified perspective view of a vertical mill of the sixth embodiment of the present invention, showing the classifier 63. The present embodiment is similar, for example, to the above-mentioned first embodiment, and the corresponding parts are given the same numbers. As the basic configuration of the vertical mill of the present embodiment is generally similar to that of FIG. 1, only special points of interest are described. One point to note in the present embodiment is that an annular movable shield ring 90 is provided, the movable shield ring 90 externally surrounding the impingement member 58 which in turn externally surrounds the rotary blades 52.

The movable shield member 90 is fixed, for example, to rods 83 which are driven by the hydraulic cylinders 82 to extend or contract. The movable shield member 90, therefore, can be moved parallel to its axis (the vertical direction in FIG. 16), and the height L4 of the clearance 91 with the top plate 57 can be freely selected.

The movable shield member 90 externally surrounds the impingement member 58 as explained above, and it is arranged to cover the opening 62 formed in the impingement member 58. Accordingly, the area of the opening 62 for the passage of the powdery material can be freely set by adjusting the height L4 of the clearance 91. The powdery material having passed through the opening 62 for the passage of the powdery material has not been classified by the rotary blades 52, and has a size distribution as indicated by the curve 204 of FIG. 5C. The powdery material having entered the space 65 or reaching the outlet port 64 via the opening 62 is then mixed with the powdery material having been classified by the rotary blades 52 and having the size distribution shown by the line 203 of FIG. 5B to obtain the size distribution shown by the line 205 of FIG. 5D.

Further, since the height L4 of the clearance 91 is variable as explained above, the present embodiment has a classifying capability which allows free setting of the width of the distribution curve of particle diameter with an average value of particle diameter freely selected.

In the above-mentioned embodiment, the movable shield member 90 is moved by hydraulic cylinders 82, but it may instead be arranged to be moved by screws in place of the hydraulic cylinders 82.

Figure 17:
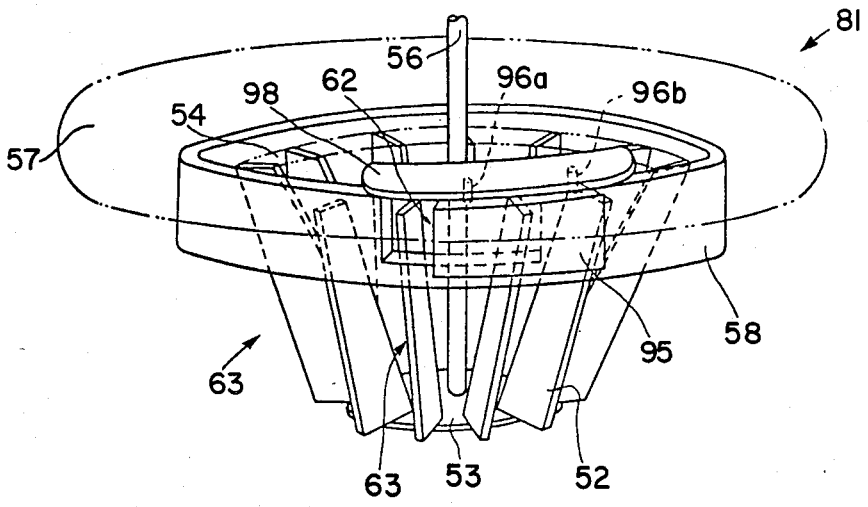
FIG. 17 is a simplified perspective view of a portion of a classifier for a vertical mill according to a seventh embodiment of the present invention.
Figure 18:
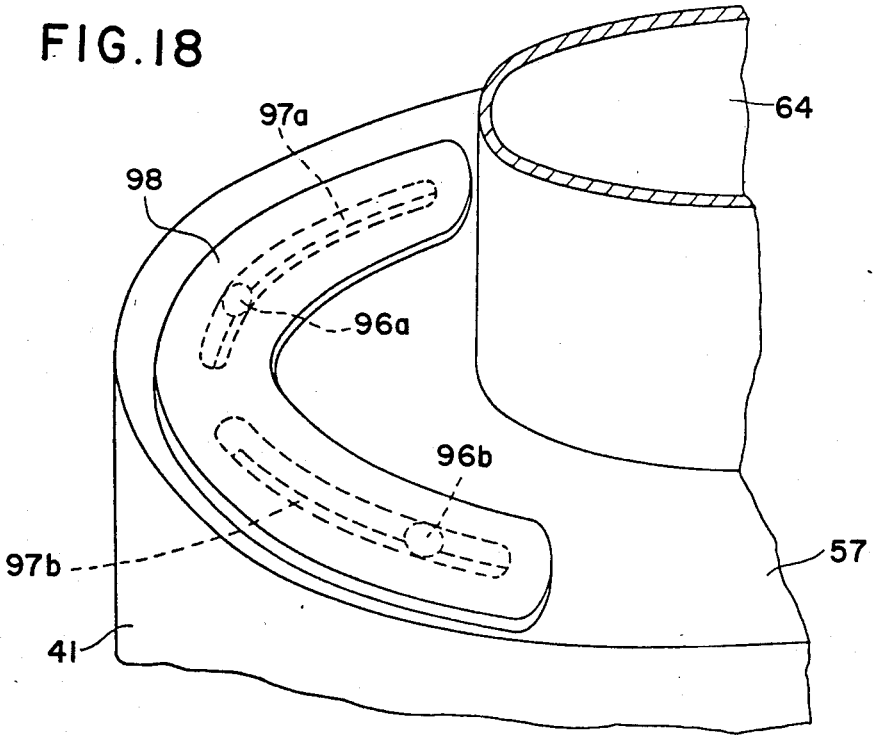
FIG. 18 is a perspective view of a portion of the vertical mill of FIG. 17, taken near a top plate of the mill.

FIG. 17 is a simplified perspective view of a portion of a classifier for a vertical mill of the seventh embodiment of the present invention. FIG. 18 is a perspective view of a portion of the vertical mill of FIG. 17, adjacent the top plate of the mill. The present embodiment is similar, for example, to the above-mentioned sixth embodiment of the present invention, and the corresponding parts are given the same reference numbers. As the basic configuration of the vertical mill of the present embodiment is similar to that of FIG. 1, only points of special interest are described. One point to note in the present embodiment is that a movable cover 95 is provided, the movable cover being capable of at least partially covering the opening 62 in the impingement member 58 which externally surrounds the rotary blades 52.

With reference to FIGS. 17 and 18, to the top end of the movable cover 95, which is capable of at least partially covering the opening 62 in the impingement member 58, are fixed the lower ends of connecting rods 96*a* and 96*b*. The other ends of the connecting rods 96*a* and 96*b* extend through arcuate slits 97*a* and 97*b* in the top plate 57 and are fixed to a movable arcuate support member 98. The movable support member 98 is arranged to cover the slits 97*a* and 97*b*, and it is capable of preventing the powdery material being contained beneath the top plate 57 from leaking out of the top plate. Further, the movable cover 95 can be shifted circumferentially relative to the opening 62 by shifting the movable support member 98 in the circumferential direction.

The area of the opening 62 for passage of the powdery material can be freely altered by shifting the movable cover 95 of the above-mentioned configuration circumferentially around the axis of the impingement member 58 using the support 98 and altering the degree of covering of the opening 62.

Further, as the powdery material having passed through the above-mentioned passage area of the opening 62 has not been classified by the rotary blades 52, the powdery material has a weight distribution having a relatively large quantity of coarse powder. The distribution is indicated by the curve 204 of FIG. 5C. The powdery material entering the space 65 after the classification by the rotary blades 52 has, as explained above, a weight distribution indicated by the line 203 of FIG. 5B, which contains much fine powder. In the space 65, these powdery materials are mixed together to produce a powdery material of which the weight distribution is as indicated by the line 205 of FIG. 5D.

Further, as the area of the flow passage of the opening 62 can be freely altered by means of the movable cover 95, together with the capability of adjusting the velocity of rotation of the rotary blades 52, the present embodiment has a classifying capability which allows free setting of the width of the particle diameter distribution, with an average value of particle diameter freely selected.

Figure 19:
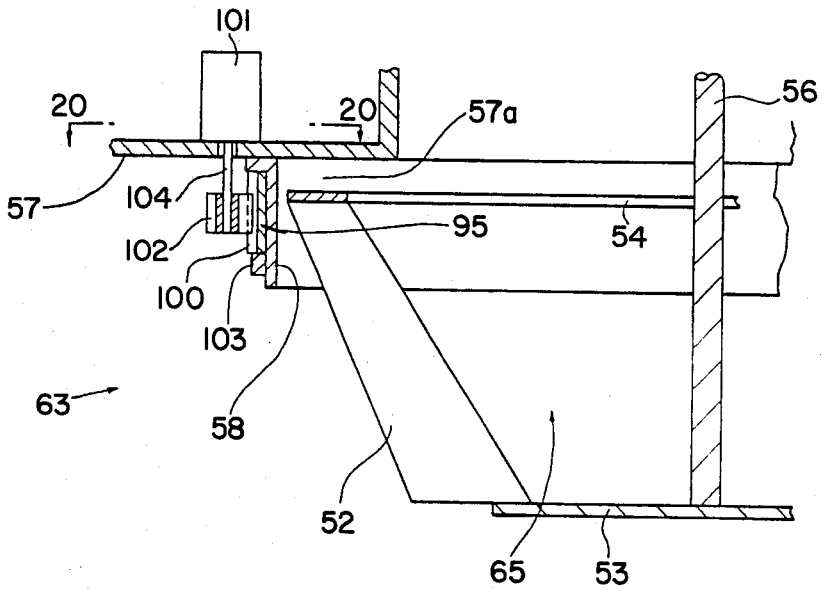
FIG. 19 is a sectional view of a portion of a classifier for a vertical mill according to an eighth embodiment of the present invention.
Figure 20:
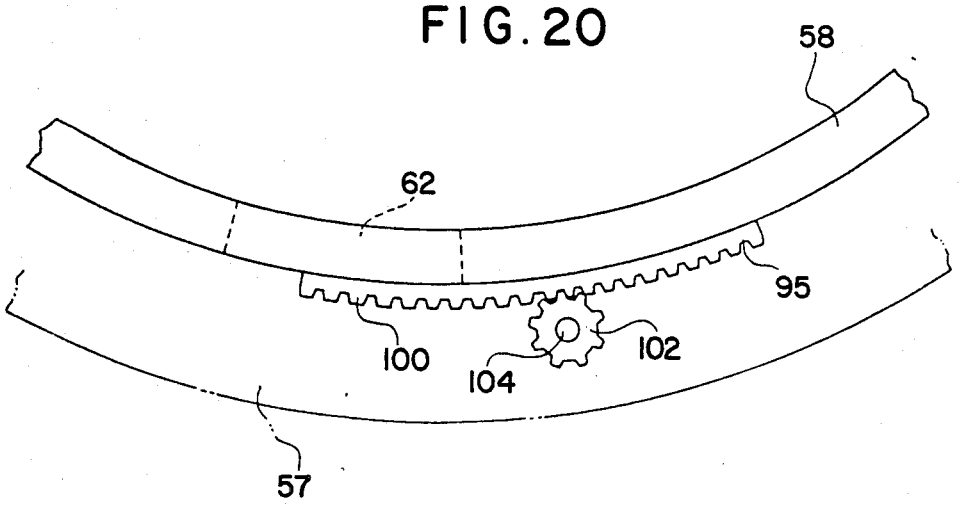
FIG. 20 is a plan view of a part of the classifier of FIG. 19.

FIG. 19 is a sectional view of a portion of a classifier 63 for a vertical mill of the eighth embodiment of the present invention, and FIG. 20 is a plan view of a part of the classifier 63. The present embodiment is similar, for example, to the above-mentioned seventh embodiment of the present invention, and the corresponding parts are given the same reference numbers. As the basic configuration of the vertical mill of the present embodiment is similar to that of FIG. 1, only points of special interest are described. A point to note of the present embodiment is that an arcuate movable cover 95 is provided, this movable cover being capable of moving to at least partially cover the opening 62 in the impingement member 58 which externally surrounds the rotary blades 52. A rack 100 is provided on a part of the movable cover 95 so that the movable cover 95 can be freely displaced along the circumference of the impingement member 58 by a rotatable pinion 102 which is rotatively driven by a driving means 101.

To the lower part of the impingement member 58 of FIG. 19 is fixed a guide member 103 which extends along the circumference of the impingement member 58. Along the outer circumference of the impingement member 58, the movable cover 95 is provided so that the cover is guided by the guide member 103. In the outer circumference of the movable cover 95 is formed the rack 100. The pinion 102 engages the rack 100 and is fixed to a rotary shaft 104, and the shaft and the pinion are freely rotatively driven clockwise or counterclockwise by the driving mean 101.

In a classifier 63 of such an arrangement, the movable cove 95 can be circumferentially displaced by rotatively driving the pinion 102 using the driving means 101. The area of the opening 62 which is open for passage of the powdery material thus can be freely altered by moving the cover 95.

The powdery material moving through the passage of the opening 62 of the classifier 63, having the above-mentioned functions, has a distribution indicated by the curve 204 of FIG. 5C because the powdery material has not been subjected to the classification by the rotary blades 52. The powdery material entering the space 65 after classification by the rotary blades 52 has a distribution indicated by the curve 203 of FIG. 5B as explained in connection with the preceding embodiment. These powdery materials are mixed together in the space 65 or at the outlet port 64 to produce a distribution indicated by the curve 205 of FIG. 5D.

Further, as the area of the passage of the opening 62 can be freely altered by shifting the position of the movable cover 95, the present embodiment has a classifying capability which allows free setting of the width of particle diameter distribution curve, with an average value of particle diameter being freely selected.

Figure 21:
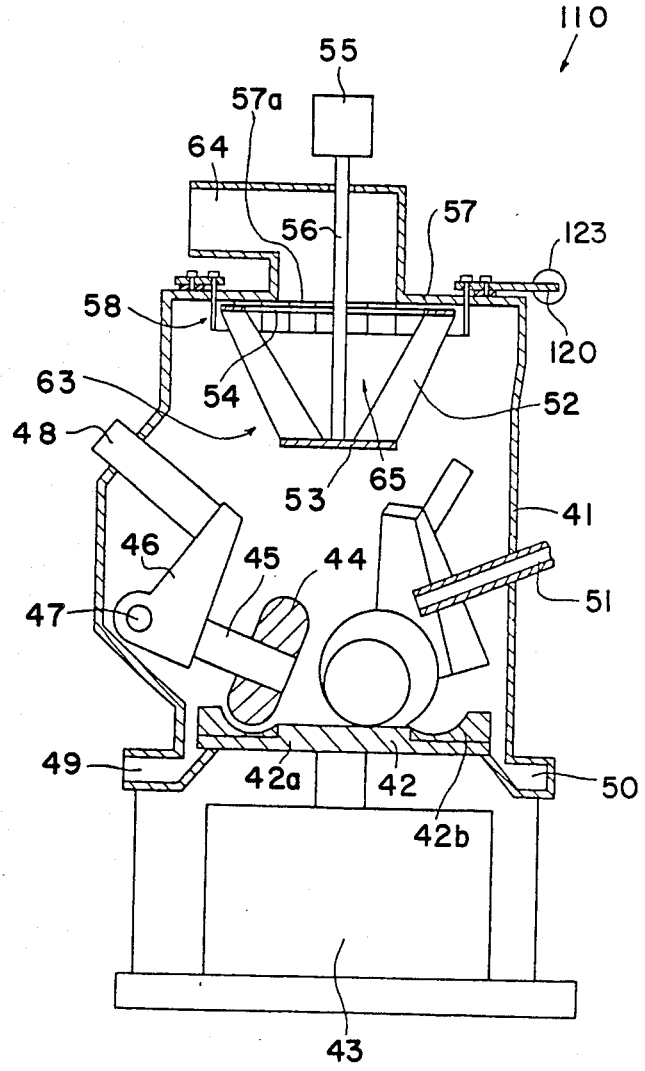
FIG. 21 is a sectional view of a vertical mill according to a ninth embodiment of the present invention.
Figure 22:
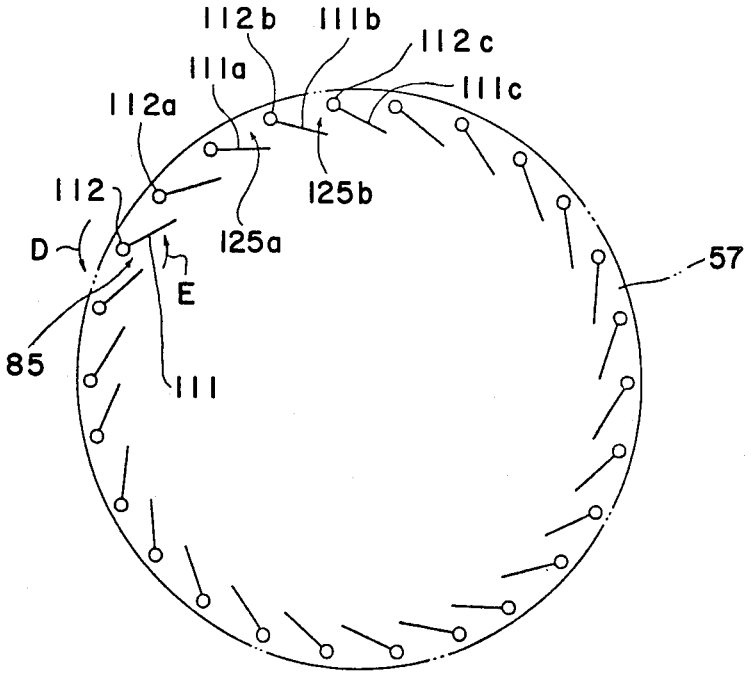
FIG. 22 is a simplified plan view illustrating the configuration of an impingement member of a vertical mill.
Figure 23:
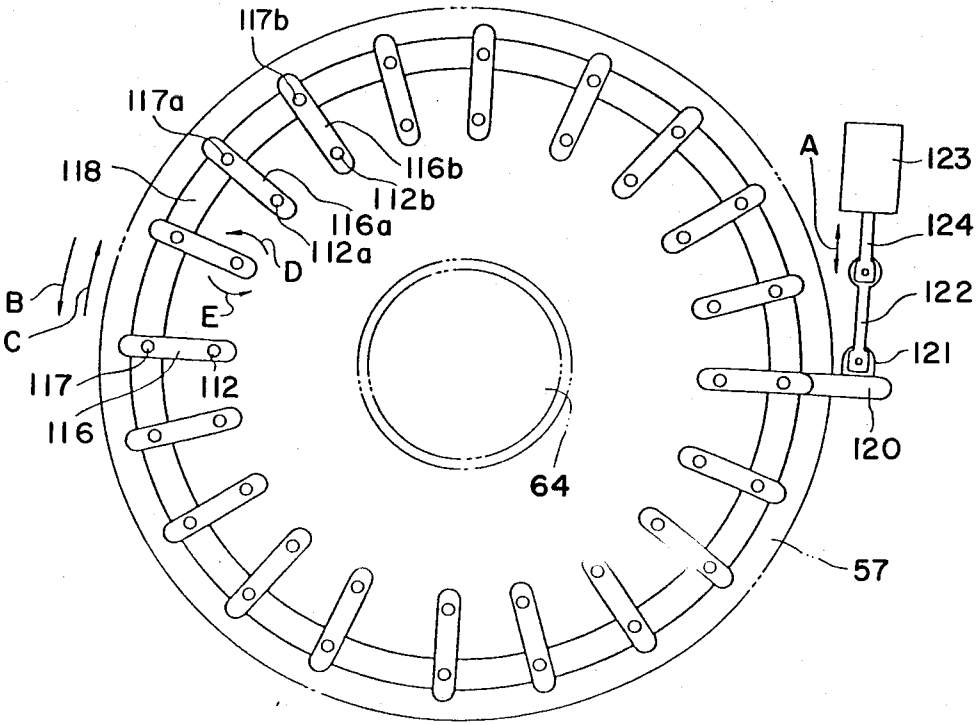
FIG. 23 is a simplified plan view of the vertical mill.
Figure 24:
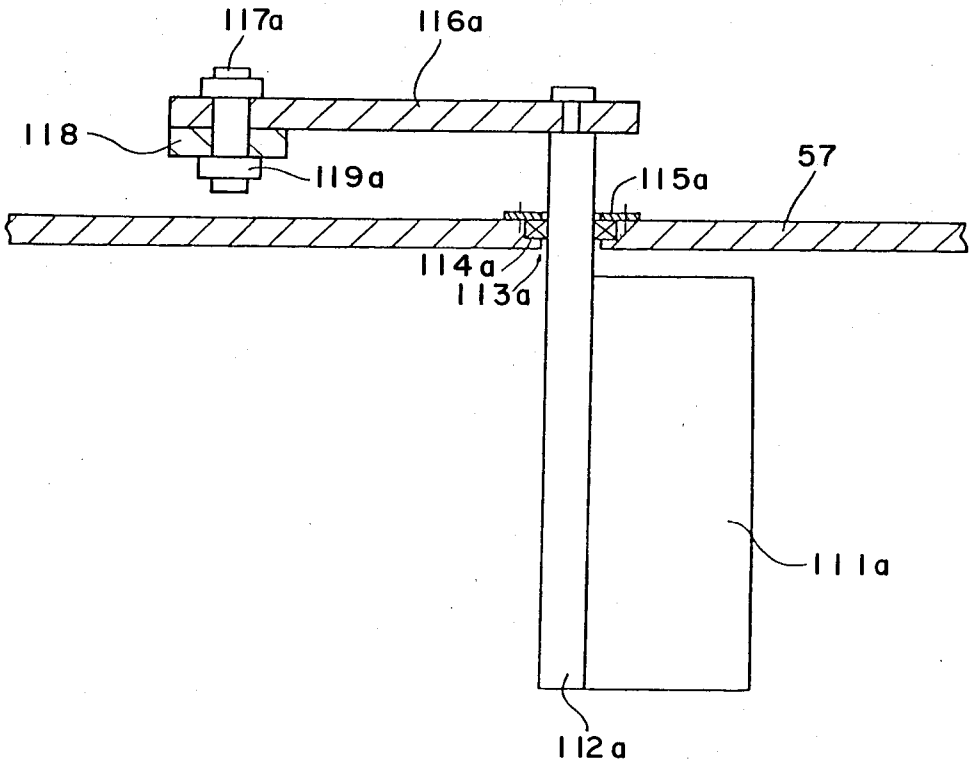
FIGS. 24 and 24A are sectional views illustrating the configuration of the impingement member.

FIG. 21 is a sectional view of a vertical mill 110 according to the ninth embodiment of the present invention; FIG. 22 is a simplified plan view for explaining the configuration of an impingement member 58 of the vertical mill 110; FIG. 23 is a simplified plan view of the vertical mill 110, and FIG. 24 is a sectional view for further explaining the configuration of the impingement member 58. The present embodiment is similar, for example, to the above-mentioned eighth embodiment of the present invention and the corresponding parts are given the same reference numbers. As the basic configuration of the vertical mill 110 of the present embodiment is similar to that of FIG. 1, only points of special interest will be described.

A point to note of the present embodiment is that the impingement member 58 is provided in the form of a large number of impingement pieces of, for example, rectangular plates 111*a*, 111*b*, 111*c*, . . . (hereinafter generally referred to by the reference number 111). The impingement pieces are arranged circumferentially of the rotary blades 52 in sequence. As shown in FIG. 22, each impingement piece 111 has, on the outer end, a rotational shaft 112 having a vertical axis of rotation.

Referring to FIGS. 23 and 24, the rotational shaft 112*a*, for example, is positioned through a through hole 113*a* in the top plate 57 and projects upwardly out of the top plate 57. The through hole 113*a* is provided with a sliding member 114*a* such as a ball bearing to assure smooth rotation of the rotational shaft 112*a* and to prevent leakage of the powdery material from the casing 41 (see FIG. 21). At the through hole 113*a*, an annular washer 115*a*, for example, is fastened to the top plate 57. The sliding member 114*a*, therefore, is fixed to the through hole 113*a*.

The rotational shaft 112*a* is fixed, near its upper end, to one end of the connecting member 116*a*. On the other end of the connecting member 116*a*, a pivotal shaft 117*a* is rotatively placed through the connecting member, in parallel with the axis of rotation of the rotational shaft 112*a*. This pivotal shaft 117 is rotatively placed through the connecting member 116*a* and an annular member 118, and is secured with, for example, a nut 119*a* to prevent detachment.

The remaining impingement pieces 111*b*, 111*c*, . . . and the components related thereto have a configuration similar to the above-described configuration of the impingement piece 111*a* (the generic reference numbers for the reference numbers 111*a* through 117*a* and 119*a* are 111 through 117 and 119, respectively). The annular ring 118 thus connects with all the pivotal shafts 117*a*, 117*b*, . . . A projection 120 is provided on the outer circumference of the annular ring 118, and a connecting piece 121, which is provided on the projection on the opposite side to the annular ring 118, is connected to a connecting link 122 by a pin in such a way that the angle between the projection and the connecting member 122 can be freely varied.

The end of the connecting member 122, which is opposite to the connecting piece 121, is connected to one end of a rod 124 by a pin, the rod being extended and contracted by a driving means 123 such as a hydraulic cylinder.

The operation of the vertical mill of the abovementioned configuration is as follows. As explained in the first embodiment, a portion of the powdery material which has been crushed and rises in the casing 41 is classified by the rotary blades 52, and enters the space 65. Another portion enters, via the impingement member 58, the space 65 or the outlet port 64.

The impingement member 58 may, as shown in FIG. 22, have a gap 125*a*, 125*b*, . . . (the generic reference number is 125) between two adjacent impingement pieces 111. The displacement of the rod 124 and of the connecting piece 122 being reciprocatively driven in the direction of the arrow A of FIG. 23 by the driving means 123, is converted into an angular displacement of the annular ring 118 because the connecting member 122 is connected to the connecting piece 121 in such a way that the angle between them can be varied.

In FIG. 23, when the annular ring 118 is angularly displaced in the direction of the arrow B or the arrow C, the respective connecting members 116 and the respective rotational shafts 112 will be angularly displaced in the direction of the arrow D or the arrow E, respectively. With reference to FIG. 22, when the respective rotational shafts 112 are angularly displaced in the direction of the arrow D, the respective impingement pieces 111 will also be angularly displaced in the same direction, and the gaps 112 between adjacent impingement pieces 111 will be reduced. When the respective rotational shafts 112 are angularly displaced in the direction of the arrow E, the respective impingement pieces 111 will also be angularly displaced in the same direction, and the gaps 125 between adjacent impingement pieces will be enlarged. The size of each ga of the impingement member 58 through which the powdery material flows can be thus freely selected.

The powdery material having passed through the gaps 125 of the impingement member 58, constituting a classifier 63 with the above-mentioned function, has the distribution indicated by the curve 204 of FIG. 5C since the material has not been classified by the rotary blades 52. The powdery material, which enters the space 65 after the classification by the rotary blades 52 as explained in this embodiment, has the distribution indicated by the curve 203 of FIG. 55B as explained in this embodiment. These powdery materials are mixed in the space 65, etc., and produce the distribution indicated by the curve 205 of FIG. 5D.

Further, since the size of the gaps 125 of the impingement member 58 can be freely selected as described above, the present embodiment has a classifying capacity which allows free setting of distribution width of particle diameter with an average value of particle diameter being freely selectable.

Figure 24A:
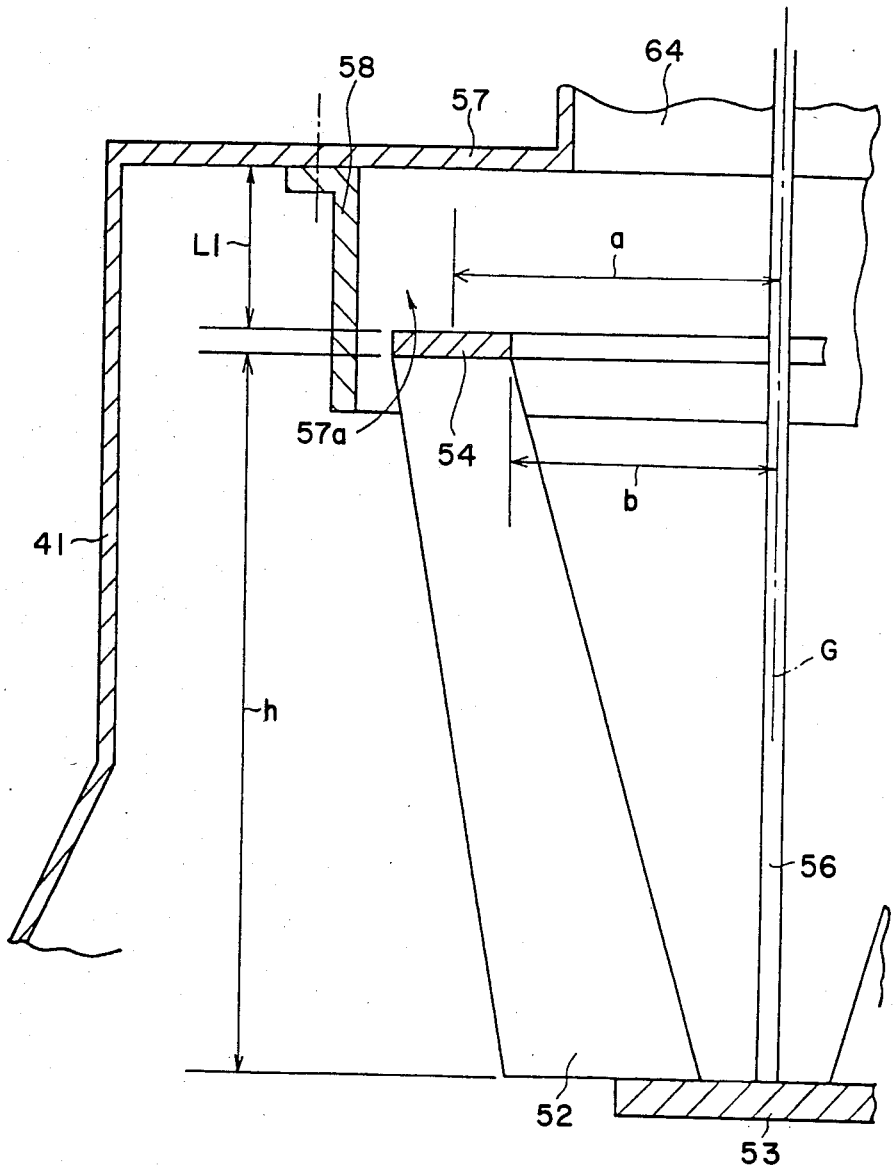

FIG. 24A is a sectional view of the vertical mill 40 of FIG. 1 near the top thereof and it is useful for explaining the operation of the classifier 63 in the first embodiment throug the ninth embodiment. In the first embodiment through the ninth embodiment, the classifying operation of the classifier 63 has been described. In FIG. 24A, the radial distance between the axis G of rotation of the rotary blades 52 and the center of the top end of a rotary blade 52, is denoted by a. The distance between the axis G of rotation and the inner circumference or edge of the fixed annular member 54 is denoted by b. The distance between the lower face of the top plate 57 and the top face of the fixed annular member 54 is denoted by L1, and the vertical height of the rotary blade 52 is denoted by h.

It has been verified by the inventors of the present invention that the classifying effect is significant when the following formula holds for the circumferential area $2\pi aL1$ of the gap 57*a* and the similar area $2\pi bh$ of the rotary blades 52.

$$2\pi aL1 > 0.03(2\pi bh) \quad (9)$$

Figure 25:
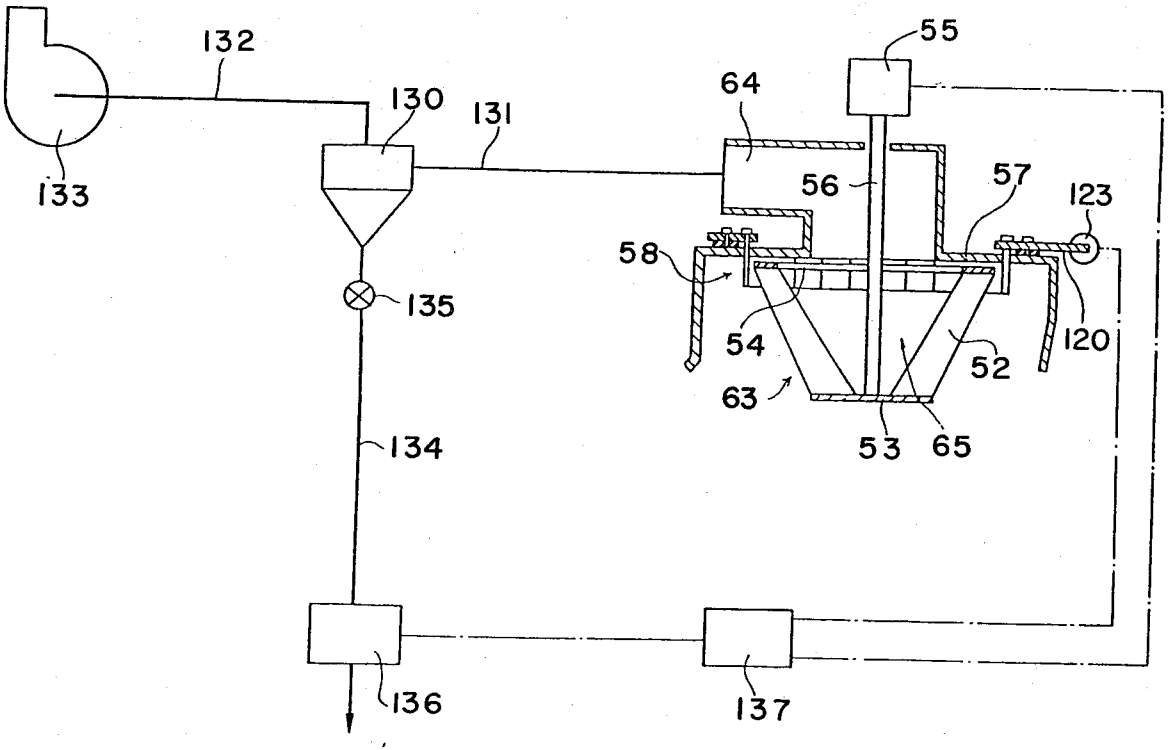
FIG. 25 is a system diagram of a controller of a classifier according to another embodiment of the present invention.
Figure 26:
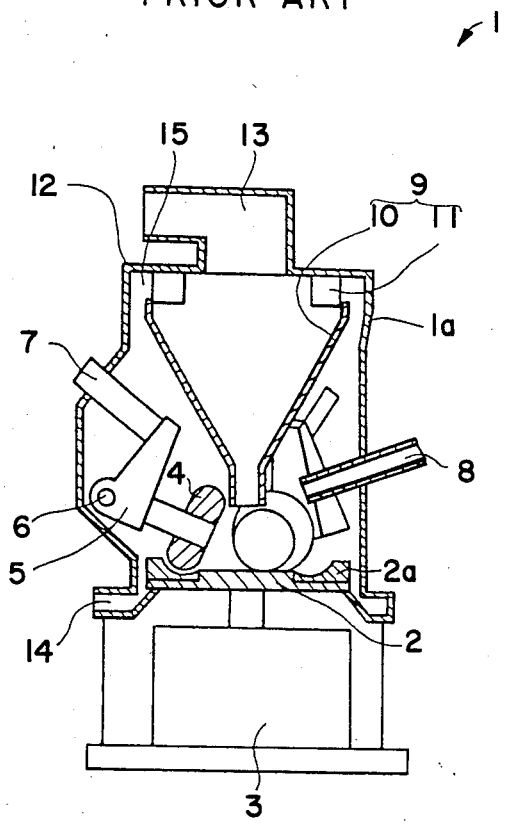
FIG. 26 PRIOR ART
FIG. 26 is a simplified sectional view of a prior art static type vertical mill.
Figure 27:
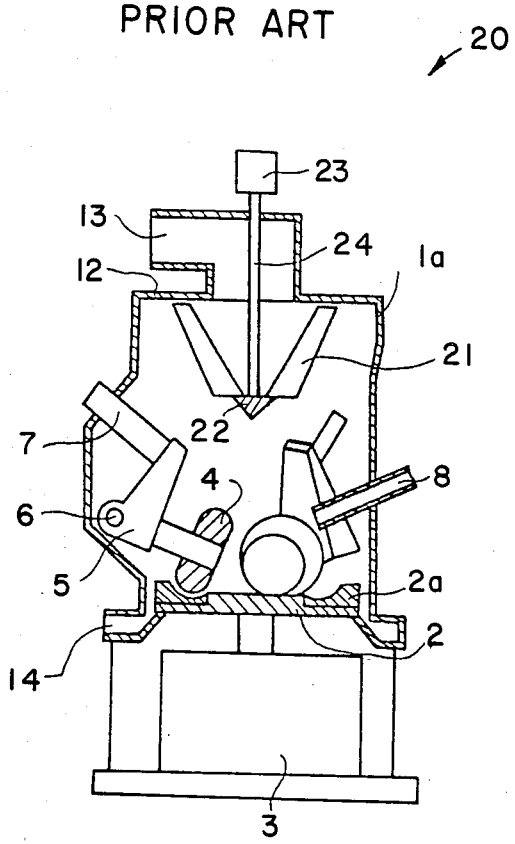
FIG. 27 PRIOR ART
FIG. 27 is a simplified sectional view of another prior art rotary blade type vertical mill.
Figure 28:
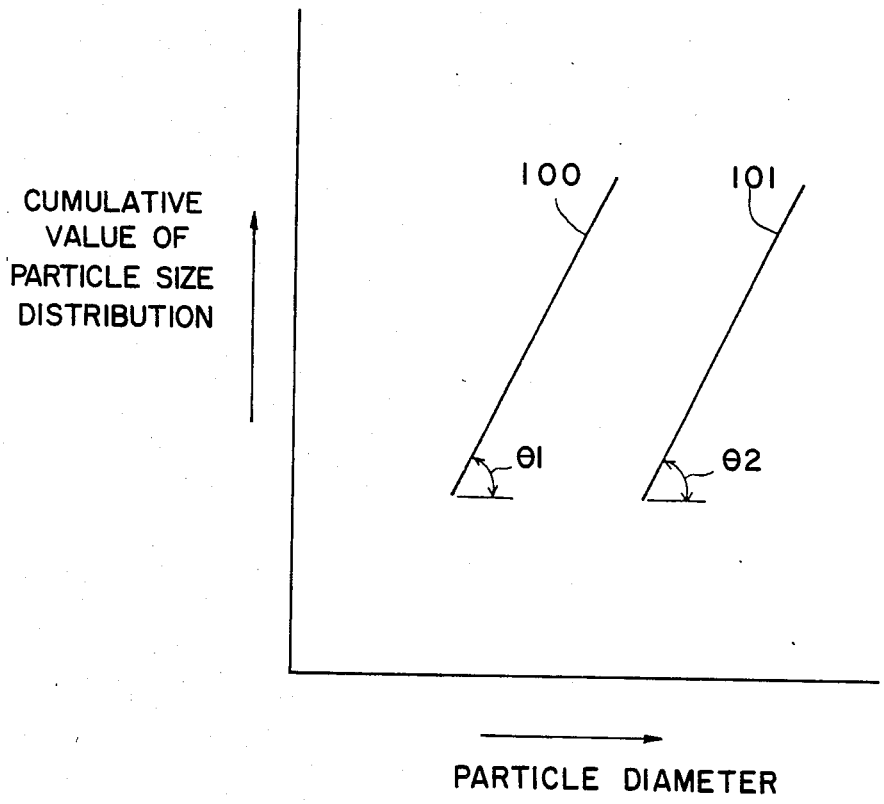
FIG. 28 is a graph illustrating the classifying function of the vertical mill of FIG. 27.
Figure 29:
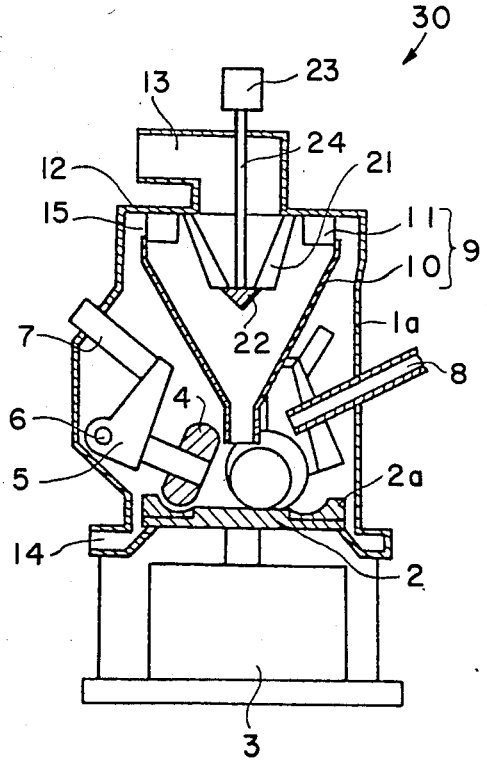
FIG. 29 PRIOR ART
FIG. 29 is a simplified sectional view of another prior art static-rotary blade type vertical mill.

FIG. 25 is a system diagram of a controller of an embodiment of the classifier 63 of the present invention. The powdery material having been classified as explained in the above-mentioned embodiments and discharged from the outlet port 64 is then conveyed via a line 131 to a cyclone separator 130 which forms a collecting means. The cyclone 130 is connected, via a line 132 to a fan 133.

On the discharge line 134 which removes the powdery material separated from the gas stream in the cyclone 130, a conventional valve means 135 is provided having the function of preventing gas from moving from the line 134 into the cyclone 130.

On the line 134 downstream of the valve means 135, a detecting means 136 is provided which detects the distribution of the particle size of the powdery material and produces outputs which represent, for example, the tangential value N5 of Equation 6 and P4 of FIG. 5D. The powdery material which has passed through the detecting means 136 is removed as the finished product.

The output values representing N5 and P4 are fed to an adjusting means 137 which adjusts the controller of the classifier 63 so that the output values of N5 and P4 will substantially equal the preselected values Nt and Pt. The adjusting means 137 performs the above-mentioned functions, and its outputs are electrically connected to, for example, the driving means 55 and 123 of the ninth embodiment shown in FIG. 21. Thus, when the measured values of N5 and P4 representing the distribution of the powder diameter of the powdery material, as detected by the detecting means 136, show some deviations from the preselected values of Nt and Pt, the adjusting means 137 compares the measured values with the preselected values and produces error signals at its outputs, and the error signals control the drives for adjusting the size of the gap 85 of the classifier 63 by energizing the driving means 123, and the speed adjusting means 55 for the rotary blades 52, etc. Thus the particle size configuration of the powdery material passing through the rotary blades 53 can be automatically adjusted and held at predetermined values.

As a result, the distribution curve of the particle diameter of the powdery material being discharged from the outlet port 64 may be changed, and the gradient and the average diameter P5 of the curve 210 of FIG. 6B may be changed. The values of N5 and P5 are thus adjusted to approach the selected values of Nt and Pt.

In summary, according to the present invention, a gap is formed in an impingement member of the classifier mounted in the casing, which allows the passage of the powdery material which is not subjected to the classification by the rotary blades of the classifier. This nonclassified portion of the powdery material is then mixed with another portion of the powdery material which has been classified by the rotary blades; the width of the distribution curve of the particle diameter of the powdery material thus obtained can be freely selected.

Furthermore, with the control system for detecting the distribution of particle diameter of the powdery material discharged after passage through the classifier and for adjusting the size of said passage area of the gap to adjust the values related to the distribution to the preselected ones, the width of the distribution curve of the particle diameter can be freely selected.

What is claimed is:

1. A vertical mill comprising an outer casing, a top plate, means adjacent the lower portion of said casing for pulverizing material, and means producing an upward flow of gas for carrying powdery material upwardly toward said top plate, a classifier comprising a plurality of rotary means mounted in said casing below said top plate and having a generally vertical axis of rotation;

said rotary means being spaced from said top plate to provide a gap between said rotary means and said top plate;

an annular impingement member suspended below the top plate and outwardly surrounding said plurality of rotary means so as to shield at least a portion of said gap; and at least one of said impingement member and said top Plate at least in part forming an opening through which said gas and powdery material pass.

2. A mill according to claim 1, wherein said opening is formed in said impingement member, and further including adjustment means on said impingement member adjacent said opening for varying the flow area of said opening.

3. A mill according to claim 2, wherein a plurality of said openings and adjustment means are provided.

4. A mill according to claim 1, wherein said impingement member is spaced from the top plate, and said opening is formed by said spacing between said top plate and said impingement member.

5. A mill according to claim 4, and further including means connected to said impingement member for adjusting said spacing and thereby the size of said opening.

6. A mill according to claim 5, and further including an annular shield member between said impingement member and the rotary means.

7. A mill according to claim 1, wherein said impingement member is formed by a plurality of spaced plates which are circumferentially spaced, said opening being formed by the spaces between said plates.

8. A mill according to claim 7, and further including mean for adjusting the angles of said plates and thereby the flow area of said opening.

9. A mill according to claim 1, and further including detecting means adapted to receive the powdery material and produce an output signal representing the particle size of the material, and adjusting means responsive to said output signal for adjusting the size of said opening.

10. A calssifier according to claim 9, and further including second adjustment means responsive to said output signal for adjusting the rate of rotation of said rotary means.

11. A vertical mill controller for a classifier of a vertical mill including a casing and means therein for pulverizing material to produce a powdery material, the classifier being mounted in the casing and the powdery material moving through the classifier to an outlet, collecting means being provided for receiving the powdery material from the outlet, the classifier further including an impingement member forming an opening for the powdery material and means 7 for adjusting the flow area of the opening, said controller including detecting means connected to said collecting means for detecting the distribution of the particle sizes of the powdery material collected by the collecting means and for forming an output signal representing said distribution, and adjustment means responsive to said output signal and connected to said classifier for adjusting said flow area to achieve a preselected distribution of particle sizes.

12. A vertical mill comprising an outer casing having a top plate, means adjacent the lower portion of the casing for pulverizing material, means producing an upward flow of gas for carrying powdery material upwardly toward the top plate, a classifier comprising a plurality of rotary means in said casing below said top plate and having a generally vertical axis of rotation, said rotary means being spaced from said top plate to provide a gap between said rotary means and the top plate, an annular impingement member suspended below the top plate and outwardly surrounding said plurality of rotary means so as to shield said gap, and said impingement member at least in part forming an opening through which said gas and powdery material pass.

13. A mill according to claim 12, wherein said opening is formed in said impingement member, and further including adjustment means on said impingement member adjacent said opening for varying th flow area of said opening.

14. A mill according to claim 12, wherein said impingement member is spaced from the top plate, and said opening is formed by said spacing between said top plate and said impingement member.

15. A mill according to claim 14, and further including means connected to said impingement member for adjusting said spacing and thereby the size of said opening.

16. A mill according to claim 15, and further including an annular shield member between said impingement member and the rotary means.

17. A mill according to claim 12, wherein said impingement member is formed by a plurality of spaced plates which are circumferentially spaced, said opening being formed by the spaces between said plates.

18. A mill according to claim 17, and further including means for adjusting the angles of said plates and thereby the flow area of said opening.

19. A mill according to claim 12, and further including detecting means adapted to receive the powdery material and produce an output signal representing the particle size of the material, and adjusting means responsive to said output signal for adjusting the size of said opening.

20. A mill according to claim 19, and further including second adjustment means responsive to said output signal for adjusting the rate of rotation of said rotary means.

* * * * *